US005598828A

United States Patent [19]

Osanai

[11] Patent Number: 5,598,828

[45] Date of Patent: Feb. 4, 1997

[54] FUEL SUPPLY CONTROL DEVICE FOR AN ENGINE

[75] Inventor: Akinori Osanai, Susono, Japan

[73] Assignee: Toyota Jidosha Kabushiki Kaisha, Aichi, Japan

[21] Appl. No.: 599,541

[22] Filed: Feb. 8, 1996

[30] Foreign Application Priority Data

Feb. 9, 1995 [JP] Japan ..... 7-021860

[51] Int. Cl.[6] ..... F02M 25/08; F02D 41/14

[52] U.S. Cl. ..... 123/675; 123/698; 123/520

[58] Field of Search ..... 126/516, 518, 126/519, 520, 698, 674; 123/325, 362, 675, 357

[56] References Cited

U.S. PATENT DOCUMENTS

| | | | |
|---|---|---|---|
| 4,630,581 | 12/1986 | Shibata | 123/325 |
| 4,961,412 | 10/1990 | Furuyama | 123/357 |
| 5,216,991 | 6/1993 | Lida et al. | 123/520 |
| 5,216,997 | 6/1993 | Osanai et al. | 123/698 |
| 5,406,927 | 4/1995 | Kato et al. | 123/674 |
| 5,425,349 | 6/1995 | Nagaishi et al. | 123/674 |
| 5,465,703 | 11/1995 | Abe | 123/520 |
| 5,501,206 | 3/1996 | Takebayashi | 123/674 |

FOREIGN PATENT DOCUMENTS

| | | |
|---|---|---|
| 62-291445 | 12/1987 | Japan . |
| 518295 | 1/1993 | Japan . |

*Primary Examiner*—Thomas N. Moulis
*Attorney, Agent, or Firm*—Kenyon & Kenyon

[57] ABSTRACT

A fuel supply control device for an engine comprises a canister in which fuel vapor is temporarily stored and from which fuel vapor is purged into the engine. When the throttle valve is in the idling position and when the engine speed N is higher than the first reference speed N1, the fuel injection and the purging operation are stopped. During the stoppage of the fuel injection and the purging operation, if the throttle valve is out of the idling position or if the engine speed N is lower than the second reference speed N2, the fuel injection and the purging operation are restarted. The reference speeds N1 and N2 are set to become higher when the storing capacity of the canister becomes lower.

40 Claims, 16 Drawing Sheets

FUEL SUPPLY CONTROL DEVICE FOR AN ENGINE

BACKGROUND OF THE INVENTION

1. Field of the Invention

The present invention relates to a fuel supply control device for an engine.

2. Description of the Related Art

In a typical engine, the engine, which is provided with a canister for temporarily storing fuel vapor therein, purges the fuel vapor stored in the canister to an intake passage thereof. On the other hand, there is also known an engine in which the fuel injection is stopped when an engine operating condition is determined to be within a selected condition range in which the fuel injection is to be stopped. In this engine, the engine operating condition is determined whether it is within the selected condition range, by comparing at least one engine operating condition parameter, which represents the engine operating condition, such as an engine speed or an opening of the throttle valve, with a corresponding, predetermined reference parameter, such as a reference speed or a reference opening. By temporarily stopping the fuel injection, the fuel consumption can be reduced.

However, if the purging operation is carried out during the stoppage of the fuel injection, the air-fuel mixture formed by the fuel vapor is very lean. Such a lean air-fuel mixture may be exhausted to the exhaust passage without being burned in the combustion chamber.

Therefore, there is known a fuel supply control device for an engine in which the purging operation is stopped when the fuel injection is stopped (see U.S. Pat. No. 4,630,581). This prevents fuel vapor from being exhausted to the exhaust passage without being burned.

In this device, fuel vapor produced in, for example, the fuel tank is introduced into the canister, and is then adsorbed in an activated charcoal arranged in the canister. Therefore, the fuel vapor is prevented from being discharged into the outside air. Next, air is introduced into the activated charcoal, and thereby fuel vapor is desorbed from the activated charcoal and is purged into the intake passage with the air. Namely, a purging operation is carried out. As a result, in the above mentioned device, when the purging operation is stopped, the desorbing of fuel vapor from the activated charcoal is stopped.

However, when a large amount of fuel vapor has already adsorbed in the activated charcoal, or when a large amount of fuel vapor is to be introduced from the fuel tank into the canister, namely, when the storing capacity of the canister is low, if the purging operation is stopped, a problem arises that fuel vapor may be discharged without being stored in the canister. In the above mentioned device, the purging operation is stopped when the fuel injection is stopped, and the fuel injection is stopped regardless the storing capacity of the canister. Namely, the purging operation is stopped regardless the storing capacity of the canister. As a result, the purging operation is stopped regardless the storing capacity of the canister. Accordingly, fuel vapor may be discharged into the outside air, without being stored in the canister.

SUMMARY OF THE INVENTION

An object of the present invention is to provide a fuel supply control device capable of preventing fuel vapor from being discharged into the outside air, while reducing a fuel consumption.

According to one aspect of the present invention, there is provided a fuel supply control device for an engine having an intake passage with a throttle valve therein, the device comprising: a fuel injector for feeding pressurized fuel to the engine; a canister for temporarily storing fuel vapor therein; a purge passage connecting the canister to the intake passage downstream of the throttle valve; purging means for purging fuel vapor stored in the canister to the intake passage via the purge passage; storing capacity calculating means for calculating a storing capacity of the canister; engine operating condition parameter obtaining means for obtaining at least one engine operating condition parameter representing the engine operating condition; reference parameter calculating means for calculating at least one reference parameter, corresponding to the engine operating condition parameter, on the basis of the storing capacity of the canister; determining means for determining whether an engine operating condition is within a selected condition range in which a fuel injection of the fuel injector is to be stopped, by comparing the at least one engine operating condition parameter with the corresponding reference parameter; fuel injection control means for controlling the fuel injector to stop the fuel injection when the determining means determines that the engine operating condition is within the selected condition range, and to allow the fuel injection when the determining means determines that the engine operating condition is outside the selected condition range; and purge control means for controlling the purge means to stop a purging operation of the purge means when the fuel injection control means stops the fuel injection, and to allow the purging operation when the fuel injection control means allows the fuel injection, wherein the reference parameter calculating means calculates the reference parameter to make the selected condition range narrower when the storing capacity of the canister becomes lower.

According to another aspect of the present invention, there is provided a fuel supply control device for an engine having an intake passage with a throttle valve, the device comprising: a fuel injector for feeding pressurized fuel to the engine; a canister for temporarily storing fuel vapor therein; a purge passage connecting the canister to the intake passage downstream of the throttle valve; purging means for purging fuel vapor stored in the canister to the intake passage via the purge passage; storing capacity calculating means for calculating a storing capacity of the canister; engine operating condition parameter obtaining means for obtaining at least one engine operating condition parameter representing an engine operating condition; parameter changing means for changing the at least one engine operating condition parameter on the basis of the storing capacity of the canister; reference parameter calculating means for calculating at least one reference parameter corresponding to the engine operating condition parameter; determining means for determining whether the engine operating condition is within a selected range in which a fuel injection of the fuel injector is to be stopped, by comparing the at least one changed engine operating condition parameter with the corresponding reference parameter; fuel injection control means for controlling the fuel injector to stop the fuel injection when the determining means determines that the engine operating condition is within the selected condition range, and to allow the fuel injection when the determining means determines that the engine operating condition is outside the selected condition range; and purge control means for controlling the purge means to stop a purging operation of the purge means when the fuel injection control means stops the fuel injection, and to allow the purging operation when the fuel injection control means allows the fuel injection, wherein the parameter changing means changes the at least one engine operating condition parameter to make the selected condition range narrower when the storing capacity of the canister becomes lower.

The present invention may be more fully understood from the description of preferred embodiments of the invention set forth below, together with the accompanying drawings.

DESCRIPTION OF THE PREFERRED EMBODIMENTS

Figure 1:
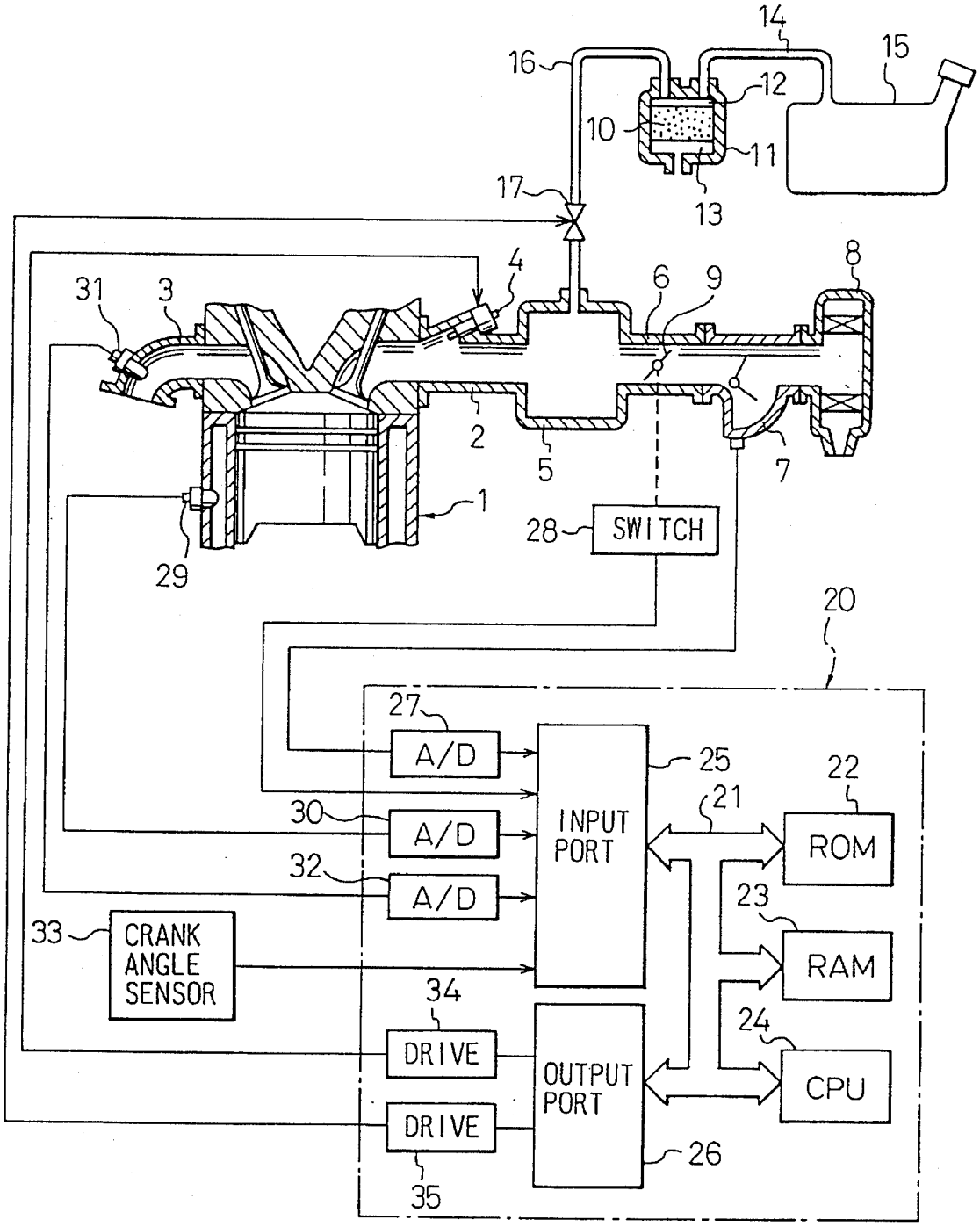
FIG. 1 is a general view of an engine.

Referring to FIG. 1, an engine body 1 is connected to intake branches 2, and to an exhaust manifold 3. A fuel injector 4 is attached to each intake branch 2. Each branch 2 is connected to a common surge tank 5, and the surge tank 5 is connected to an air cleaner 8 via an intake duct 6 and an air-flow meter 7. In the intake duct 6, a throttle valve 9 is arranged.

As shown in FIG. 1, there is provided a canister 11 housing with an activated charcoal 10 therein. The canister 11 has a fuel vapor chamber 12 and an air chamber 13 on each side of the activated charcoal. The fuel vapor chamber 12 is connected to a fuel tank 15 via a conduit 14, and to the surge tank 5 via a conduit 16. The air chamber 13 communicates the atmosphere. The conduit 16 is provided with a purge control valve 17 controlled by output signals output by an electronic control unit 20. Fuel vapor produced in the fuel tank 15 is introduced into the canister 11 via the conduit 14, and is adsorbed in the activated charcoal 10. When the purge control valve is opened, air is introduced from the air chamber 13 to the conduit 16 through the activated charcoal 10. The air desorbes fuel vapor from the activated charcoal 10 when passing therethrough. As a result, the air including fuel vapor, namely a purge gas is fed into the surge tank 5 via the conduit 16. Namely, the purging operation is carried out. When the purge control valve is opened, fuel vapor produced in the fuel tank 15 is introduced into the fuel vapor chamber 12, and is purged into the surge tank 5 without being adsorbed in the activated charcoal 10.

The electronic control unit 20 is constructed as a digital computer and comprises a read-only memory (ROM) 22, a random-access memory (RAM) 23, the CPU (micro processor) 24, an input port 25, and an output port 26. ROM 22, RAM 23, CPU 24, the input port 25, and the output port 26 are interconnected to each other via a bidirectional bus 21. The air-flow meter 7 generates an output voltage in proportion to an amount of air fed into the engine, and this output voltage is input to the input port 25 via an AD converter 27. The throttle valve 9 is attached to a throttle switch 28, which turns ON when an opening of the throttle valve is an idling opening. The output signal of the throttle switch 28 is input to the input port 25. A water temperature sensor 29 is attached to the engine body 1, and generates an output voltage in proportion to the temperature of engine cooling water. The output voltage of the sensor 29 is input to the input port 25 via an AD converter 30. An air-fuel sensor 31 is attached to the exhaust manifold 3, and generates an output voltage representing an air-fuel ratio. The output voltage of the sensor 31 is input to the input port 25 via an AD converter 32. The input port 25 is also connected to a crank angle sensor 33, which generates a pulse whenever a crankshaft is turned by, for example, 30 degrees. According to the pulses, the CPU 54 calculates the engine speed. The output port 26 is connected to the fuel injector 14, and the purge control valve 17 via respective drive circuits 34 and 35.

In the internal combustion engine shown in FIG. 1, basically the fuel injection time TAU is calculated based on the following equation:

$$TAU=TP\cdot\{1+KK+(FAF-1)+FPG\}$$

where,

TP: Basic fuel injection time

KK: Enrichment correction coefficient

FAF: Feedback correction coefficient

FPG: Purge A/F correction coefficient

The basic fuel injection time TP is the injection time, found by experiment, necessary for making the air-fuel ratio to the target air-fuel ratio. The basic fuel injection time TP is stored in advance in the ROM 22 as a function of the engine load Q/N (intake air amount/engine speed N) and the engine speed N.

The enrichment correction coefficient KK expresses both the coefficient of increase during warm-up and the coefficient of increase during acceleration. When there is no need for correction to increase the amount, the enrichment correction coefficient KK becomes zero.

The purge A/F correction coefficient FPG is for correction of the amount of fuel to be injected by the fuel injector 4, when the purging operation is carried out. When the purging operation is stopped, FPG becomes zero.

The feedback correction coefficient FAF is for controlling the air-fuel ratio to the target air-fuel ratio based on the output signal of the air-fuel ratio sensor 31. As the target air-fuel ratio, use may be made of any air-fuel ratio, but in the embodiment shown in FIG. 1, the target air-fuel ratio is made the stoichiometric air-fuel ratio, and therefore an explanation will be made of the case where the target air-fuel ratio is made the stoichiometric air-fuel ratio. Note that when the target air-fuel ratio is the stoichiometric air-fuel ratio, use is made as the air-fuel ratio sensor 31 of a sensor where the output voltage changes in accordance with the concentration of oxygen in the exhaust gas. Therefore, the air-fuel ratio sensor 31 is hereinafter referred to as an $O_2$ sensor.

The $O_2$ sensor 31 outputs a voltage of approximately 0.9 volts when the air-fuel ratio is on the rich side of the stoichiometric air-fuel ratio, and of approximately 0.1 volts when the air-fuel ratio is on the lean side of the stoichiometric air-fuel ratio. Next, a control of the feedback correction coefficient FAF based on the output signals of the $O_2$ sensor 31 will be explained.

Figure 2:
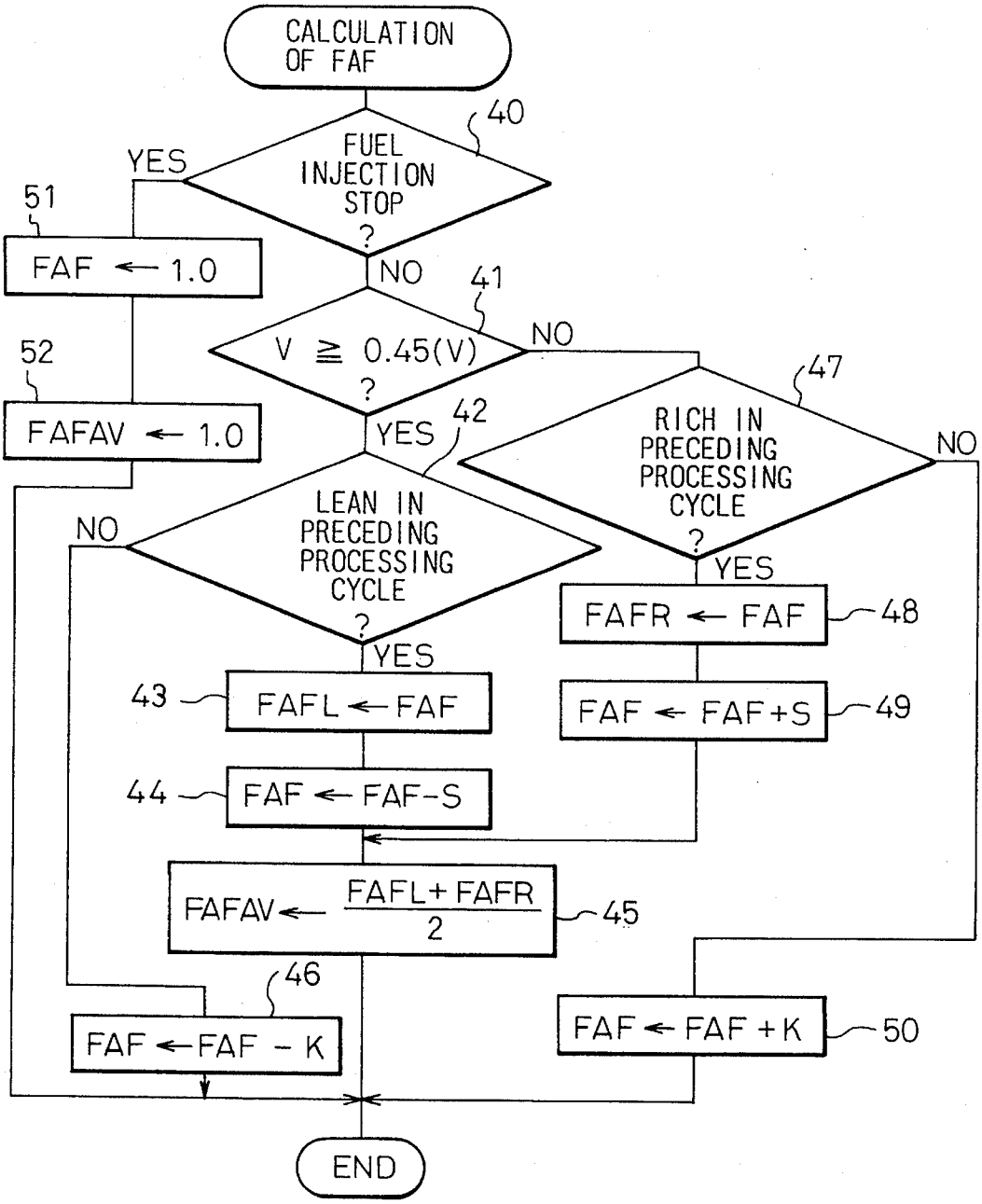
FIG. 2 is a flowchart for calculating a feedback correction coefficient.

FIG. 2 shows a routine for calculating the feedback correction coefficient FAF. This routine is executed in, for example, a main routine of the engine.

Figure 3:
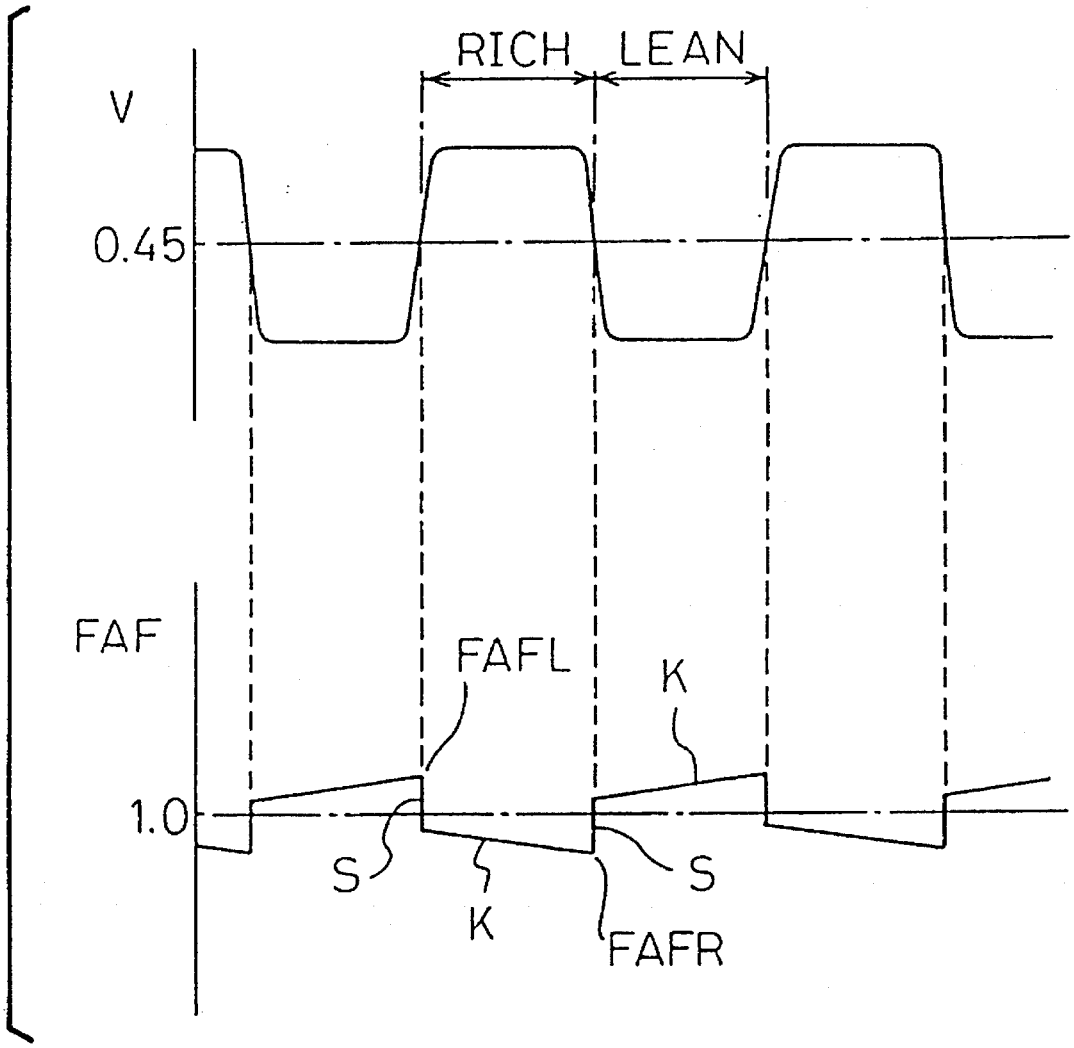
FIG. 3 is a diagram illustrating a variation in a feedback correction coefficient.

Referring to FIG. 2, first, in step 40, it is determined whether the fuel injection is stopped. Note that, in the engine shown in FIG. 1, the fuel injection is stopped when the engine operating condition is a specific condition (described hereinafter). Generally, the fuel injection is carried out, and thus the routine generally goes to step 41. In step 41, it is determined whether the output voltage V of the $O_2$ sensor 31 is higher than 0.45 V, namely, whether the air-fuel ratio is on the rich side of the stoichiometric air-fuel ratio. If $V \geqq 0.45$ V, namely, if the air-fuel ratio is on the rich side of the stoichiometric air-fuel ratio, the routine goes to step 42, where it is determined whether the air-fuel ratio was on the lean side of the stoichiometric air-fuel ratio in the previous processing cycle. If it is determined that the air-fuel ratio was on the lean side in the previous processing cycle, namely, if it is determined that the air-fuel ratio has changed from the lean side to the rich side, the routine goes to step 43, where the feedback correction coefficient FAF is memorized as FAFL. In following step 44, the skip value S is subtracted from the feedback correction coefficient FAF, and thereby the feedback correction coefficient FAF is drastically decreased, as shown in FIG. 3. In following step 45, the average of FAFL and FAFR is memorized as FAFAV. Then, the processing cycle is ended.

Conversely, if it is determined, in step 42, that the air-fuel ratio was on the rich side of the stoichiometric air-fuel ratio in the previous processing cycle, the routine goes to step 46, where the integral value K ($K \ll S$) is subtracted from the feedback correction coefficient FAF. In this case, the feedback correction coefficient FAF is gradually decreased, as shown in FIG. 3.

If it is determined in step 41 that $V<0.45$ V, namely, if it is determined that the air-fuel ratio is on the lean side of the stoichiometric ratio, the routine goes to step 47, where it is determined whether the air-fuel ratio was on the rich side in the previous processing cycle. If it is determined that the air-fuel ratio was on the rich side in the previous processing cycle, namely if it is determined that the air-fuel ratio has changed from the rich side to the lean side, the routine goes to step 48, the feedback correction coefficient FAF is memorized as FAFR. In following step 49, the skip value S is added to the feedback correction coefficient FAF, and thereby, the feedback correction coefficient FAF is drastically increased, as shown in FIG. 3. In the following step 45, the average of FAFL and FAFR is memorized as FAFAV. Then, the processing cycle is ended. Conversely, if it is determined, in step 47, that the air-fuel ratio was on the lean side of the stoichiometric air-fuel ratio in the previous processing cycle, the routine goes to step 50, where the integral value K is added to the feedback correction coefficient FAF. In this case, the feedback correction coefficient FAF is gradually increased, as shown in FIG. 3.

If the fuel injection is stopped, in step 40, the routine goes to step 51, where the feedback correction coefficient FAF is made 1.0. In following step 52, FAFAV is also made 1.0. Then, the processing cycle is ended.

When the air-fuel ratio becomes on the rich side and thereby the feedback correction coefficient increases, the fuel injection time TAU is made shorter. When the air-fuel ratio becomes on the lean side and thereby the feedback correction coefficient decreases, the fuel injection time TAU is made longer. As a result, the air-fuel ratio is maintained to the target, stoichiometric air-fuel ratio. In this connection, the feedback correction coefficient FAF alternately increases and decreases relative to 1.0, when the purging operation is stopped. Further, the value FAFAV calculated in step 44 represents the average of the feedback correction coefficient, as can be understood from FIG. 3.

In the engine shown in FIG. 1, an amount of the purge gas is controlled by controlling a purge ratio PGR to a target purge ratio TPGR, where the purge ratio PGR is a ratio of the amount of the purge gas to the amount of air fed into the engine. If the concentration of fuel vapor in the purge gas is substantially constant, the concentration of fuel vapor in air fed into the engine is kept substantially constant, as long as the purge ratio PGR is kept at the constant target purge ratio TPGR. This results in preventing an undesired fluctuation in the air-fuel ratio.

However, if a large amount of fuel vapor is purged into the engine at the beginning of the purging operation, the air-fuel ratio is no longer kept at the stoichiometric air-fuel ratio, even if the purge ratio PGR is kept at the constant target purge ratio TPGR. To solve this problem, in this embodiment, the target purge ratio TPGR is increased gradually when the purging operation is started, and is kept a predetermined constant value when it reaches the constant value. This results in preventing an undesired fluctuation in the air-fuel ratio.

The concentration of fuel vapor in air fed into the engine is proportional to the purge ratio PGR, and to the concentration of fuel vapor in air fed into the engine per unit purge ratio. Therefore, the air-fuel ratio is kept at the stoichiometric air-fuel ratio, by correcting the amount of fuel to be injected by the fuel injector 4 based on the product of the purge ratio PGR and the concentration of fuel vapor in air fed into the engine per unit purge ratio, when the purging operation is carried out.

In this embodiment, a coefficient FGPG is introduced, which coefficient represents the concentration of fuel vapor in air fed into the engine per unit purge ratio. This coefficient FGPG is made 1.0 when the concentration of fuel vapor in air fed into the engine per unit purge ratio is zero, and becomes larger as the concentration of fuel vapor in the air fed into the engine per unit purge ratio becomes larger. In this embodiment, the purge A/F correction coefficient PGR described above is represented by a negative value of a product of a change in the fuel vapor concentration coefficient FGPG−1 and the purge ratio PGR. In this case, when the concentration of fuel vapor increases and the change in the fuel vapor concentration coefficient FGPG−1 increases, the amount of fuel to be injected decreases, and when the concentration of fuel vapor decreases and the change in the fuel vapor concentration coefficient FGPG−1 decreases, the amount of fuel to be injected increases, as can be understood from the equation for calculating TAU. As a result, the air-fuel ratio is kept at the stoichiometric air-fuel ratio.

During the purging operation, if the concentration of fuel vapor in air fed into the engine changes, the feedback correction coefficient FAF or the average of the feedback correction coefficient FAFAV also changes. Therefore, in this embodiment, the fuel vapor concentration coefficient FGPG is calculated based on the deviation in FAF or FAFAV. Next, method of calculating the fuel vapor concentration coefficient FGPG will be explained, with reference to FIG. 4.

Figure 4:
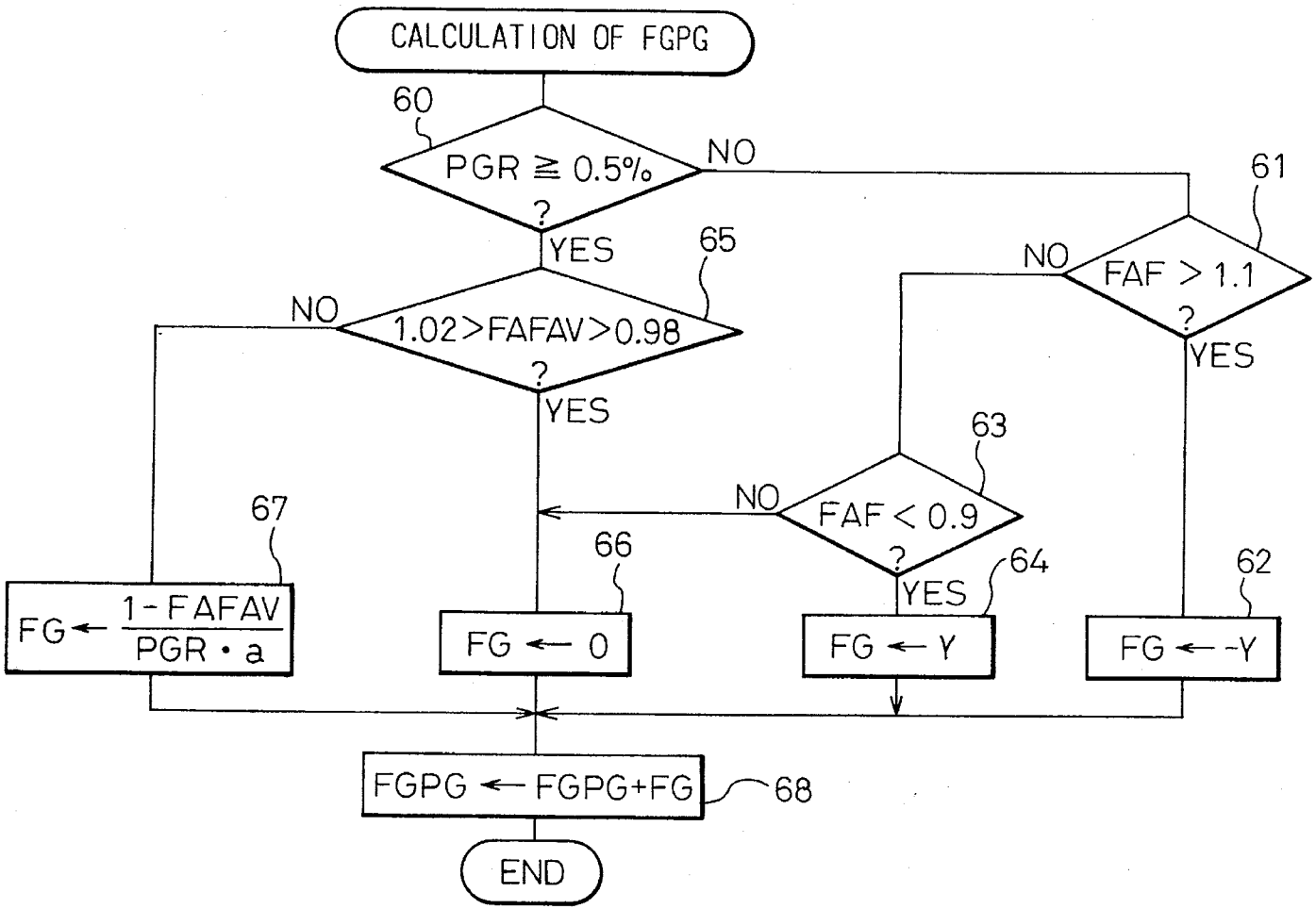
FIG. 4 is a flowchart for calculating a fuel vapor concentration coefficient.

FIG. 4 shows a routine for calculating the fuel vapor concentration coefficient FGPG. This routine is executed in, for example, the main routine.

Referring to FIG. 4, first, in step 60, it is determined whether the actual purge ratio PGR is larger or equal to 0.5%. If PGR<0.5%, the routine goes to step 61, where it is determined whether the feedback correction coefficient FAF is larger than 1.1. If FAF>1.1, the routine goes to step 62, where a renewal value FG for the fuel vapor concentration coefficient FGPG is made −Y. Here, Y is positive and constant. Then, the routine goes to step 68. Contrarily, if FAF≦1.1, in step 61, the routine goes to step 63, where it is determined whether FAF is smaller than 0.9. If FAF<0.9, the routine goes to step 64, where the renewal value FG is made Y. Then, the routine goes to step 68. If FAF≧0.9, namely, if 0.9≦FAF≦1.1, the routine goes to step 66.

If PGR<0.5% in step 60, the routine goes to step 65, where it is determined whether the average of the feedback correction coefficient FAFAV is within the range from 0.98 to 1.02. If 0.98<FAFAV<1.02, the routine goes to step 66, where the renewal value FG is made zero. Then, the routine goes to step 68. If FAFAV≦0.98, or 1.02≦FAFAV, in step 65, the routine goes to step 67, where the renewal value FG is calculated using the following equation:

$$FG=(1-FAFAV)/(PGR\cdot a)$$

where a is constant. Namely, the renewal value FG is calculated based on the change in the average of the feedback correction coefficient FAFAV per unit purge ratio. Then, the routine goes to step 68.

In step 68, the fuel vapor concentration coefficient FGPG is renewed by adding the renewal value FG to the coefficient FGPG calculated in the previous cycle. Then, the processing cycle is ended.

Note that, when the fuel injection is stopped, the feedback correction coefficient FAF and the average FAFAV are both made 1.0, as shown in FIG. 2. In this case, the renewal value FG is made zero. Therefore, during stoppage of the fuel injection, the fuel vapor concentration coefficient FGPG is kept unchanged from the value just before the fuel injection is stopped.

When the purging operation starts, the feedback correction coefficient FAF decreases gradually. The decrement of the feedback correction coefficient FAF represents the concentration of fuel vapor in air fed into the engine. Therefore, when the fuel vapor concentration coefficient FGPG is calculated on the basis of the change in the feedback correction coefficient 1−FAF using the routine shown in FIG. 4, and the coefficient FAF becomes 1.0 accurately, the change in the fuel vapor concentration coefficient FGPG−1 represents the concentration of fuel vapor in air fed into the engine per unit purge ratio, accurately.

Further, in the engine shown in FIG. 1, the fuel injection is temporarily stopped when it is determined that the engine operation condition within a selected condition range in which the fuel injection is to be stopped. The determination is performed by comparing engine operating condition parameters, representing the engine operating condition, with corresponding reference parameters. In this embodiment, the engine speed and the opening of the throttle valve are used as the engine operating condition parameters, and first and second selected reference speeds and an idling opening are used as the reference parameters.

Namely, when the throttle switch 28 is made ON and the engine speed N is higher than the first reference speed N1, the engine operating condition is determined to be within the selected condition range, and the fuel injection is stopped. This helps to reduce the fuel consumption. During the stoppage of the fuel injection, when the throttle switch 28 is turned OFF, or when the engine speed N is lower than the second reference speed N2, which is lower than the first reference speed N1, the engine operating condition is determined to be without the selected condition range, and the fuel injection is resumed. This results in ensuring a large engine output power, or preventing misfiring.

Figure 5:
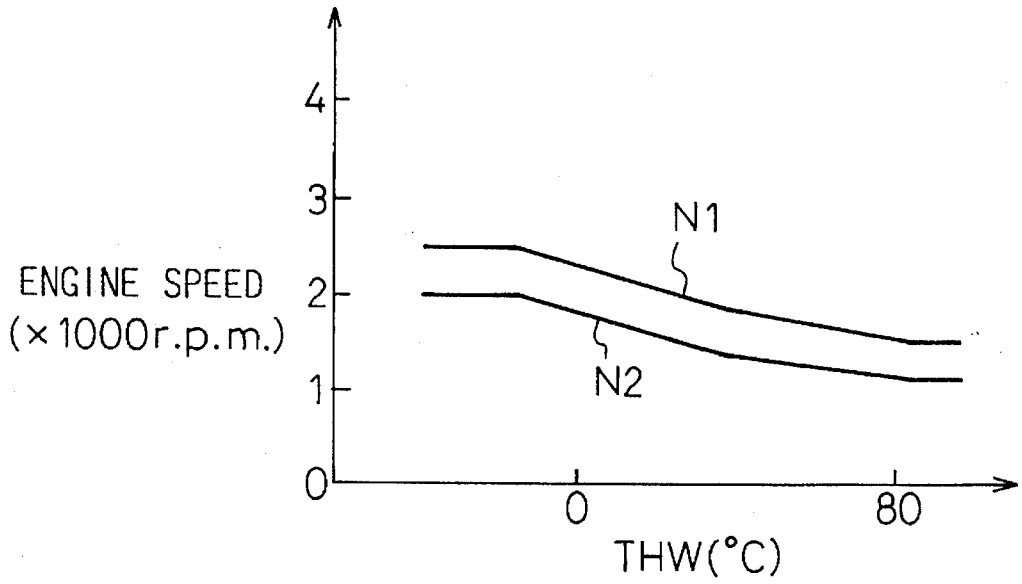
FIG. 5 is a diagram illustrating first and second reference speeds, as a function of an engine temperature.

FIG. 5 illustrates an example of the first and the second reference speeds N1 and N2. In this example, the first and the second reference speeds N1 and N2 are stored as a function of the temperature of the engine cooling water THW representing the engine temperature, in advance in the ROM 22. When the cooling water temperature THW is low, such as during the warming-up, if the fuel injection is stopped, it is difficult to ensure a proper combustion of fuel in the combustion chamber at the restarting of the fuel injection. Therefore, in the example shown in FIG. 5, the first and the second reference speeds N1 and N2 are selected so that the selected condition range becomes narrower when the cooling water temperature THW becomes lower.

Namely, the fuel injection is continuously carried out when the engine speed N is lower than the first reference speed N1, even if the throttle switch 28 is turned ON. Therefore, the selected condition range becomes narrower when the first reference speed N1 becomes higher. On the other hand, during the stoppage of the fuel injection, the fuel injection is resumed when the engine speed becomes lower than the second reference speed N2, even if the throttle switch 28 is turned ON. Therefore, the selected condition range becomes narrower when the second reference speed N2 becomes higher. Thus, the selected condition range becomes narrower when the cooling water temperature THW becomes lower, by setting the first and the second reference speeds N1 and N2 to become higher, respectively, when the cooling water temperature THW becomes lower. As a result, in the example shown in FIG. 5, the proper combustion of fuel is ensured. The reference speeds N1 and N2 are stored in advance in the ROM 22, in the form of the map as shown in FIG. 5.

In this way, the temporary stoppage of the fuel injection helps to reduce the fuel consumption. However, during the stoppage of the fuel injection, if the purging operation is carried out, the air-fuel mixture formed by fuel vapor in the combustion chamber is very lean. And, such a lean air-fuel mixture may be exhausted to the exhaust manifold 3 without being burned. Therefore, in the engine shown in FIG. 1, the purging operation is stopped during the stoppage of the fuel injection.

When the purge control valve 17 is closed to thereby stop the purging operation, fuel vapor introduced from the fuel tank 15 to the canister 11 is introduced into the activated charcoal 10 and is adsorbed therein. In this condition, when a large amount of fuel vapor is already adsorbed in the activated charcoal 10, or when a large amount of fuel vapor is to be introduced from the fuel tank 15 into the canister 11, namely, when the storing capacity of the canister 11 is low, if the purging operation is stopped due to the stoppage of the fuel injection, fuel vapor may be discharged without being stored in the activated charcoal 10.

When the determination whether the engine operating condition is within the selected condition range is performed using the reference speeds N1 and N2 calculated with the map shown in FIG. 5, the fuel injection is stopped regardless of the storing capacity of the canister 11. As a result, fuel vapor may be discharged without being stored in the canister 11.

To solve this problem, in this embodiment, the reference speeds N1 and N2 are set to become larger when the storing capacity of the canister 11 becomes lower, to thereby make the selected condition range narrower when the storing capacity of the canister 11 becomes lower. This results in preventing fuel vapor from being discharged into the outside air without being stored in the canister 11.

The storing capacity of the canister is obtained on the basis of the concentration of fuel vapor. Namely, the concentration of fuel vapor in air fed into the engine is large when the canister 11 has adsorbed a large amount of fuel vapor during the purging operation. Also, when a large amount of fuel vapor is introduced from the fuel tank 15 into the canister 11 during the purging operation, the fuel vapor concentration is higher because fuel vapor in the fuel tank 15 is purged into the surge tank 5 without being temporarily adsorbed in the activated charcoal 10 during the purging operation. Namely, the change in the fuel vapor concentration coefficient FGPG−1 becomes larger when the amount of fuel vapor adsorbed in the canister 11 becomes larger, or when the amount of fuel vapor introduced from the fuel tank 15 into the canister 11 becomes larger. In other words, it can be found that the storing capacity of the canister 11 becomes lower, when the change in the fuel vapor concentration coefficient FGPG−1 becomes larger.

Figure 6:
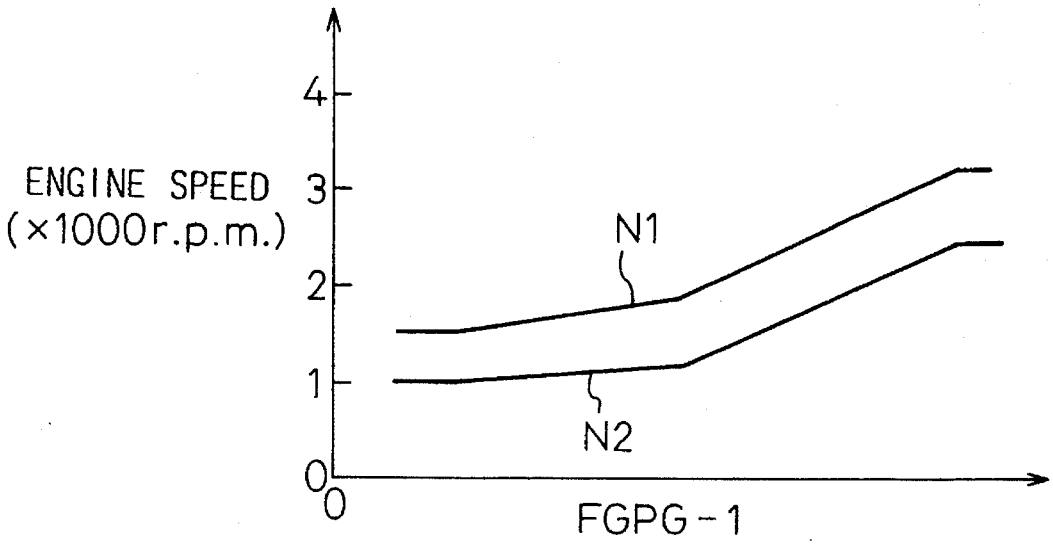
FIG. 6 is a diagram illustrating first and second reference speeds, as a function of a change in a fuel vapor concentration coefficient.

Therefore, the first and the second reference speeds N1 and N2 are set to become larger when the storing capacity of the canister 11 becomes lower, as shown in FIG. 6. Accordingly, the selected condition range becomes narrower when the storing capacity of the canister 11 becomes lower. This results in preventing the adsorbing capacity of the canister 11 from being made very low, and also preventing fuel vapor from being discharged into the outside air without being stored in the canister 11. The reference speeds N1 and N2 are stored in advance in the ROM 22 in the form of the map as shown in FIG. 6.

The second reference speed N2 becomes higher, when the amount of fuel vapor to be purged into the engine when the purging operation is to be restarted due to the restart of the fuel injection becomes larger. Therefore, an undesirably wide change in an engine output torque is reduced at the restart of the purging operation because the engine speed N is relatively high at this time.

Note that the reference speeds N1 and N2 are calculated using the map of FIG. 5 when the change in the fuel vapor concentration coefficient FGPG−1 is very small, namely, when (FGPG−1) is smaller than a predetermined value FF. When the (FGPG−1) is larger than a predetermined value FF, the reference speeds N1 and N2 are calculated using the map of FIG. 6.

Next, the routines for executing the first embodiment mentioned above are explained, with reference to FIGS. 7 to 10.

Figure 7:
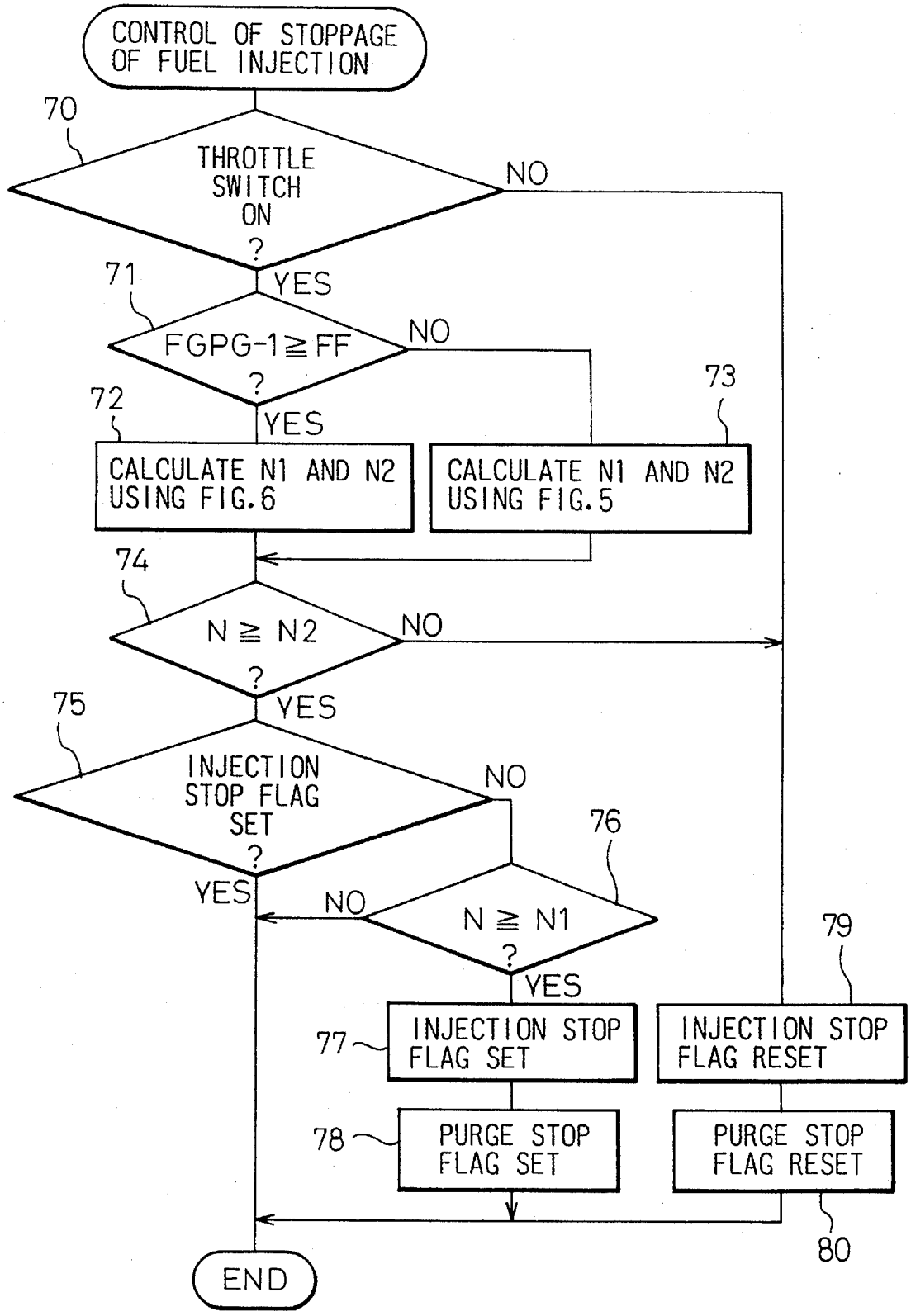
FIG. 7 is a flowchart for executing a control of a stoppage of a fuel injection, according to the first embodiment.

FIG. 7 illustrates a routine for controlling the stoppage of the fuel injection. This routine is executed in, for example, the main routine of the engine.

Referring to FIG. 7, first, in step 70, it is determined whether the throttle switch 28 is turned ON. If the throttle switch 28 is turned ON, the routine goes to step 71, and if the switch 28 is turned OFF, the routine goes to steps 79 and 80. In step 71, it is determined whether the change in the fuel vapor concentration coefficient FGPG−1 is larger than the predetermined value FF. If FGPG−1≧FF, the routine goes to step 72, where the first and the second reference speeds N1 and N2 are calculated using the map shown in FIG. 6, in accordance with the change (FGPG−1). Namely, the reference speeds N1 and N2 are calculated in accordance with the storing capacity of the canister 11. Then, the routine goes to step 74.

Contrarily, if FGPG−1<FF, the routine goes to step 73, where the first and the second reference speeds N1 and N2 are calculated using the map shown in FIG. 5, in accordance with the engine cooling water temperature THW. Then, the routine goes to step 74.

In step 74, it is determined whether the current engine speed N is larger than or equal to the second reference speed N2 obtained in step 72 or 73. If N≧N2, the routine goes to step 75. If N<N2, the routine goes to steps 79 and 80. In step 75, it is determined whether an injection stop flag, which is set when the fuel injection is to be stopped, is set. Note that the injection stop flag and a purge stop flag (explained hereinafter) are reset in an initialization process executed once when an ignition switch (not shown) is turned ON. Therefore, when it is a first time for the routine to go to step 75 after the engine starts, the injection stop flag is reset, and thus, the routine goes from step 75 to step 76. In step 76, it is determined whether the engine speed N is higher than or equal to the first reference speed N1 obtained in step 72 or 73. If N≧N1, the routine goes to step 77, where the injection stop flag is set. In following step 78, a purge stop flag, which is set when the purging operation is to be stopped, is also set. Namely, the fuel injection and the purging operation are stopped, when the throttle switch 28 is turned ON and when N≧N1. Then, the processing cycle is ended.

Contrarily, if N<N1 in step 76, the processing cycle is ended. Namely, both flags remain reset when the injection stop flag is reset and when N<N1. Namely, the fuel injection and the purging operation are continuously carried out.

On the other hand, if the injection stop flag is set in step 75, the processing cycle is ended. Namely, the fuel injection and the purging operation are continuously stopped until the engine speed N becomes lower than N2, because the routine goes to step 75 as long as N≧N2.

The routine goes to steps 79 and 80 when the throttle switch 28 is turned OFF in step 70 or when N<N2 in step 74. In steps 79 and 80, the injection stop flag and the purge stop flag are both reset. Namely, the fuel injection and the purging operation are carried out.

Figure 8:
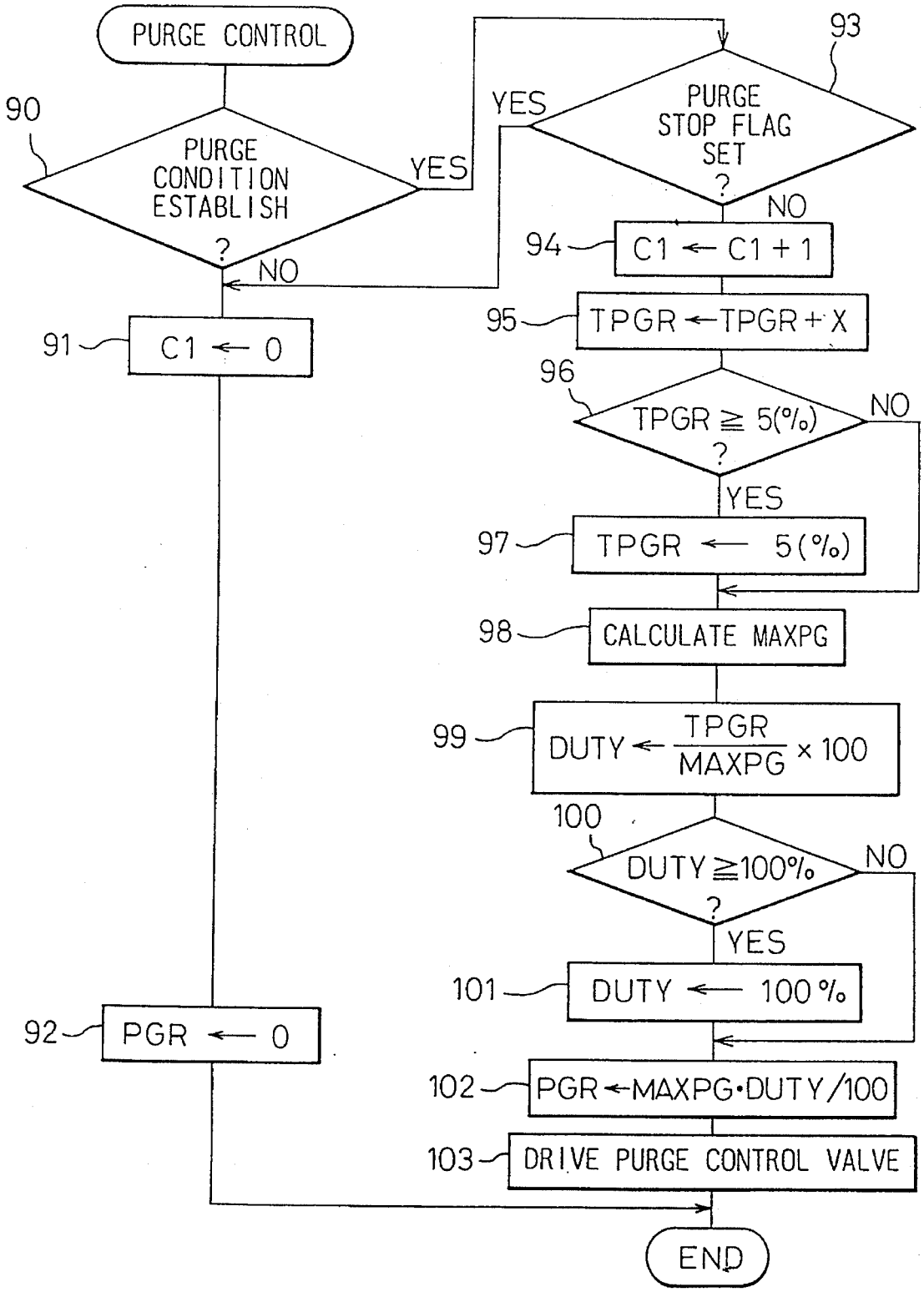
FIG. 8 is a flowchart for executing a control of purge control.

FIG. 8 illustrates a routine for executing the purge control. This routine is executed by interruption every predetermined time, such as every 100 ms.

Referring to FIG. 8, first, in step 90, it is determined whether a purge condition in which the purging operation can be carried out is established. In this embodiment, it is determined that the purge condition is established when the engine cooling water temperature THW is above 80° C., the feedback control of the air-fuel ratio is started, the skipping operation of the feedback correction coefficient FAF (S as shown in FIG. 3) is carried out more than five times, and the learning control of the feedback correction coefficient FAF is finished. If it is determined that the purge condition is not established, the routine goes to steps 91 and 92.

Contrarily, if it is determined that the purge condition is established, the routine goes to step 93, where it is determined whether the purge stop flag, which is set or reset in the routine shown in FIG. 7, is set. If the purge stop flag is set, the routine goes to step 94. If the purge stop flag is reset, in step 93, the routine goes to steps 91 and 92.

In step 93, a counter value C1, which represents a period during which the purging operation is carried out, is incremented by one.

If the purge stop flag is reset in step 94, the routine goes to steps 91 and 92. Namely, the routine goes to steps 91 and 92, when the purge condition is not established or when the purge stop flag is reset. In step 91, the counter value C1 is made zero. In step 92, the purge ratio PGR is also made zero. Then, the processing cycle is ended.

In following step 95, the target purge ratio TPGR is calculated on the basis of the following equation:

$$TPGR=TPGR+X$$

where X is a small constant. The target purge ratio TPGR has been made zero in the initialization. In following step 96, it is determined whether the target purge ratio TPGR is larger than or equal to 5%. If TPGR<5%, the routine jumps to step 98. If TPGR≧5%, the routine goes to step 97, where the target purge ratio TPGR is made 5%, and then, the routine goes to step 98. When the actual purge ratio is relatively large, it is difficult to control the actual air-fuel ratio equal to the stoichiometric air-fuel ratio. Therefore, in this embodiment, the target purge ratio TPGR is kept at 5% or below.

Figure 9A:
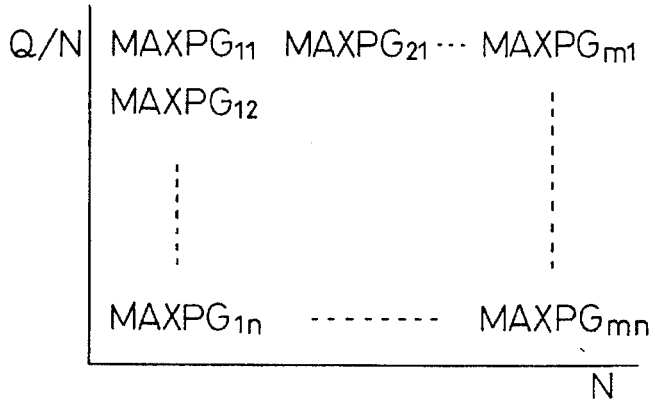
FIGS. 9A through 9C are diagrams illustrating a maximum purge ratios.
Figure 9B:
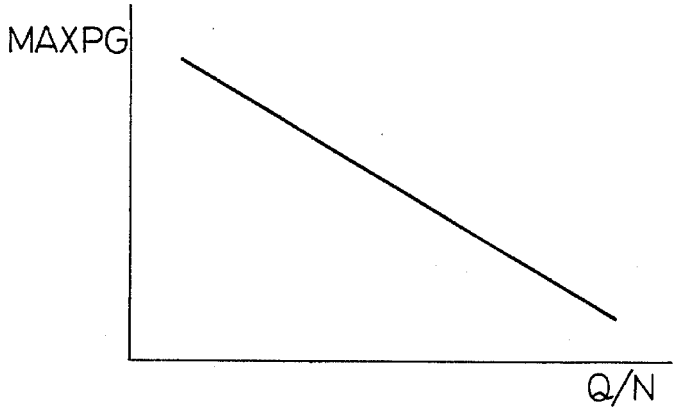
Figure 9C:
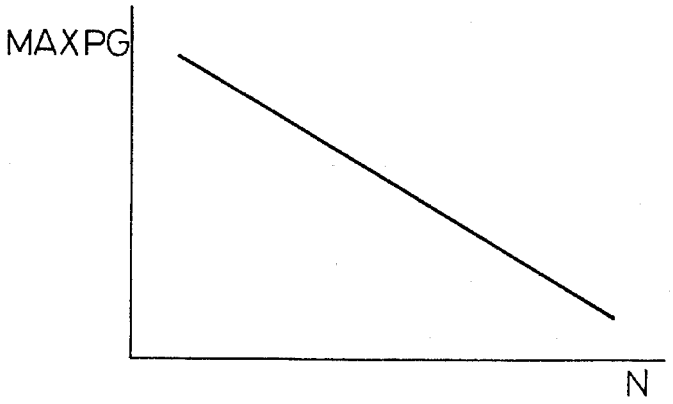

Note that, in the engine shown in FIG. 1, an opening ratio of the purge control valve 17 is determined in accordance with a ratio of the target purge ratio TPGR to a reference purge ratio which is determined by the engine operating condition, for example, a maximum purge ratio MAXPG. The maximum purge ratio MAXPG is a ratio of the amount of the purge gas to that of air fed into the engine Q, when the purge control valve 17 is fully opened, and is stored as a function of the engine load Q/N and the engine speed N, in advance, in the ROM 22 in the form of the map as shown in FIG. 9A. The maximum purge ratio MAXPG becomes larger, when the engine load Q/N becomes smaller, under a constant engine speed N, as shown in FIG. 9B. MAXPG becomes larger, when the engine speed N becomes lower, under the constant engine load Q/N, as shown in FIG. 9C. In this embodiment, when the purging operation is to be carried out, the opening ratio of the purge control valve 17 is controlled by controlling a duty ratio, and the duty ratio is controlled in accordance with a ratio of the target purge ratio TPGR to the maximum purge ratio MAXPG. The duty ratio is defined as a ratio of a period during which the purge control valve is opened to a duty cycle time, in each duty cycle.

Referring to FIG. 8 again, in step 98, the maximum purge ratio MAXPG is calculated using the map shown in FIG. 9A. In following step 99, the duty ratio DUTY for the purge control valve 17 is calculated using the following equation:

$$DUTY=(TPGR/MAXPG)\cdot 100$$

In following step 100, the it is determined whether the duty ratio DUTY calculated in step 99 is larger than or equal to 100%. If DUTY<100%, the routine jumps to step 102. If DUTY≧100%, the routine goes to step 101, where the duty ratio DUTY is made 100%. Then, the routine goes to step 102.

In step 102, the actual purge ratio PGR is calculated using the following equation:

$$PGR=MAXPG\cdot DUTY/100$$

If the duty ratio DUTY calculated in step 99 exceeds 100%, the duty ratio DUTY is compulsorily made 100%. Therefore, in this case, the actual purge ratio PGR deviates from the target purger ratio TPGR. Note that, the actual purge ratio PGR confirms to the target purge ratio TPGR, as long as the (TPGR/MAXPG)·100 does not exceed 100%.

In following step 103, the purge control valve 17 is driven in accordance with the duty ratio DUTY.

Figure 10:
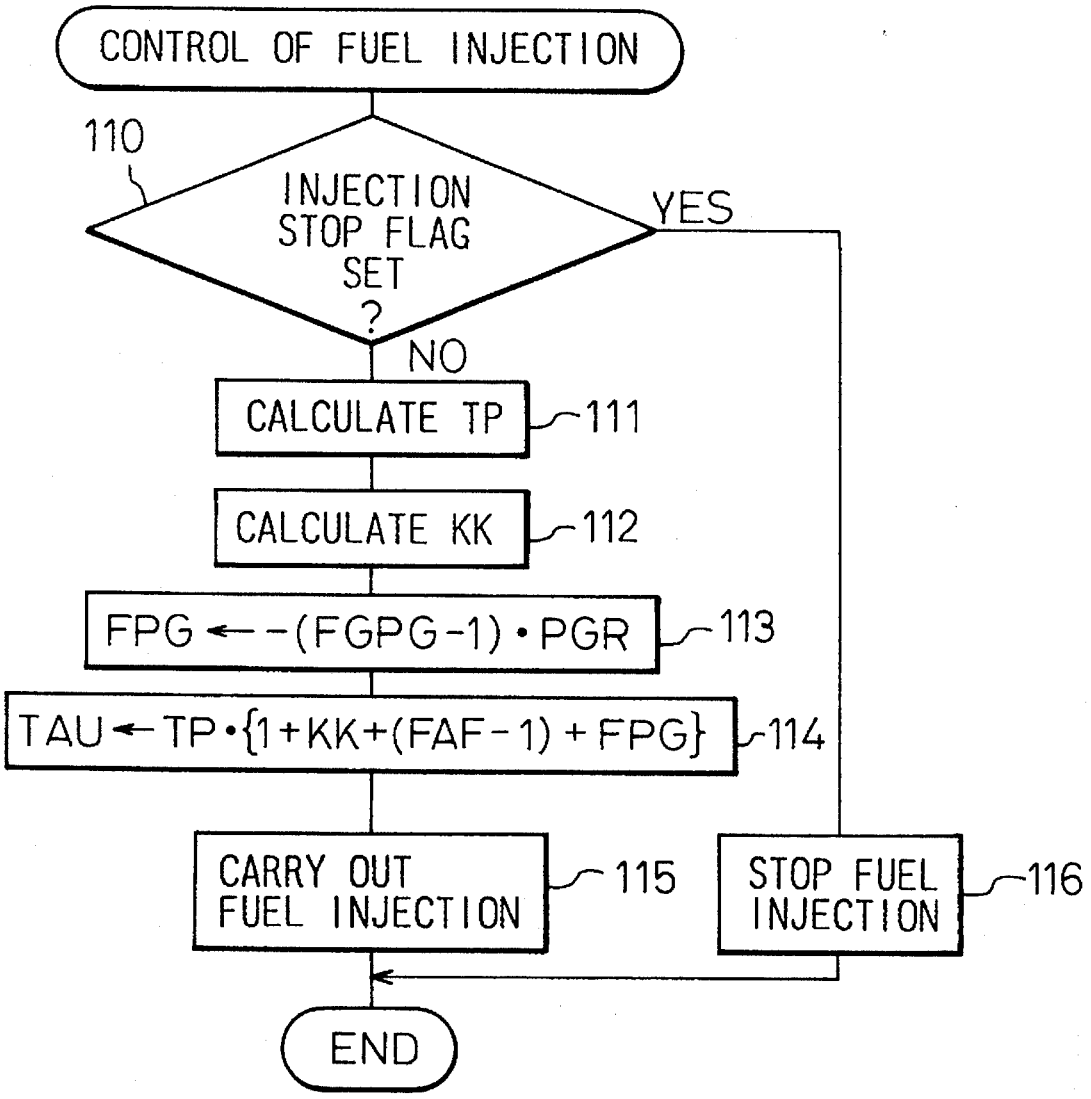
FIG. 10 is a flowchart for controlling a fuel injection.

FIG. 10 illustrates a routine for controlling the fuel injection. This routine is executed in, for example, the main routine of the engine.

Referring to FIG. 10, first, in step 110, it is determined whether the injection stop flag, which is set or reset in the routine shown in FIG. 7, is set. If the injection stop flag is reset, the routine goes to steps 111 and 112. In step 111, the basic fuel injection time TP is calculated, and in step 112, the enrichment correction coefficient KK is calculated. In following step 113, purge A/F correction coefficient FPG is calculated using the following equation:

$$FPG=-(FGPG-1)\cdot PGR$$

In following step 114, the fuel injection time TAU is calculated using the following equation:

$$TAU=TP\cdot\{1+KK+(FAF-1)+FPG\}$$

Next, the routine goes to step 115, where the fuel injection is carried out by the fuel injector 4 in accordance with the fuel injection time TAU. Then, the processing cycle is ended.

Contrarily, if the purge stop flag is set in step 110, the routine goes to step 116, where the fuel injection is stopped. Then, the processing cycle is ended.

Next, a second embodiment of the present invention will be explained.

In a typical engine, fuel pumped from the fuel tank 15 by a fuel pump (not shown) is distributed to the fuel injector 4 via a distributor conduit (not shown). A pressure regulating valve is arranged in the distributor conduit. The valve passes the fuel in the distributor conduit when the fuel pressure therein reaches a desired pressure, to thereby make the fuel pressure in the distributor conduit equal to the desired pressure. The passed fuel returns into the fuel tank, via a return conduit.

The distributor conduit and the return conduit are generally positioned near the combustion chamber, and thus, the temperature of the returned fuel is relatively high. The high temperature fuel returned into the fuel tank heats the fuel in the fuel tank. Therefore, it becomes easier to generate fuel vapor in the fuel tank, when the engine operating period becomes longer.

Accordingly, in this embodiment, when the engine operating period is shorter than a predetermined period, it is judged that the amount of fuel vapor generated in the fuel tank 15 is small and that the adsorbing capacity of the canister 11 is high. In this case, the reference speeds N1 and N2 are calculated using the map shown in FIG. 5. On the other hand, when the engine operating period is longer than the predetermined period, it is judged that the amount of fuel vapor generated in the fuel tank 15 is large and that the adsorbing capacity of the canister 11 would be low. In this case, the reference speeds N1 and N2 are calculated using the map shown in FIG. 6.

Figure 11:
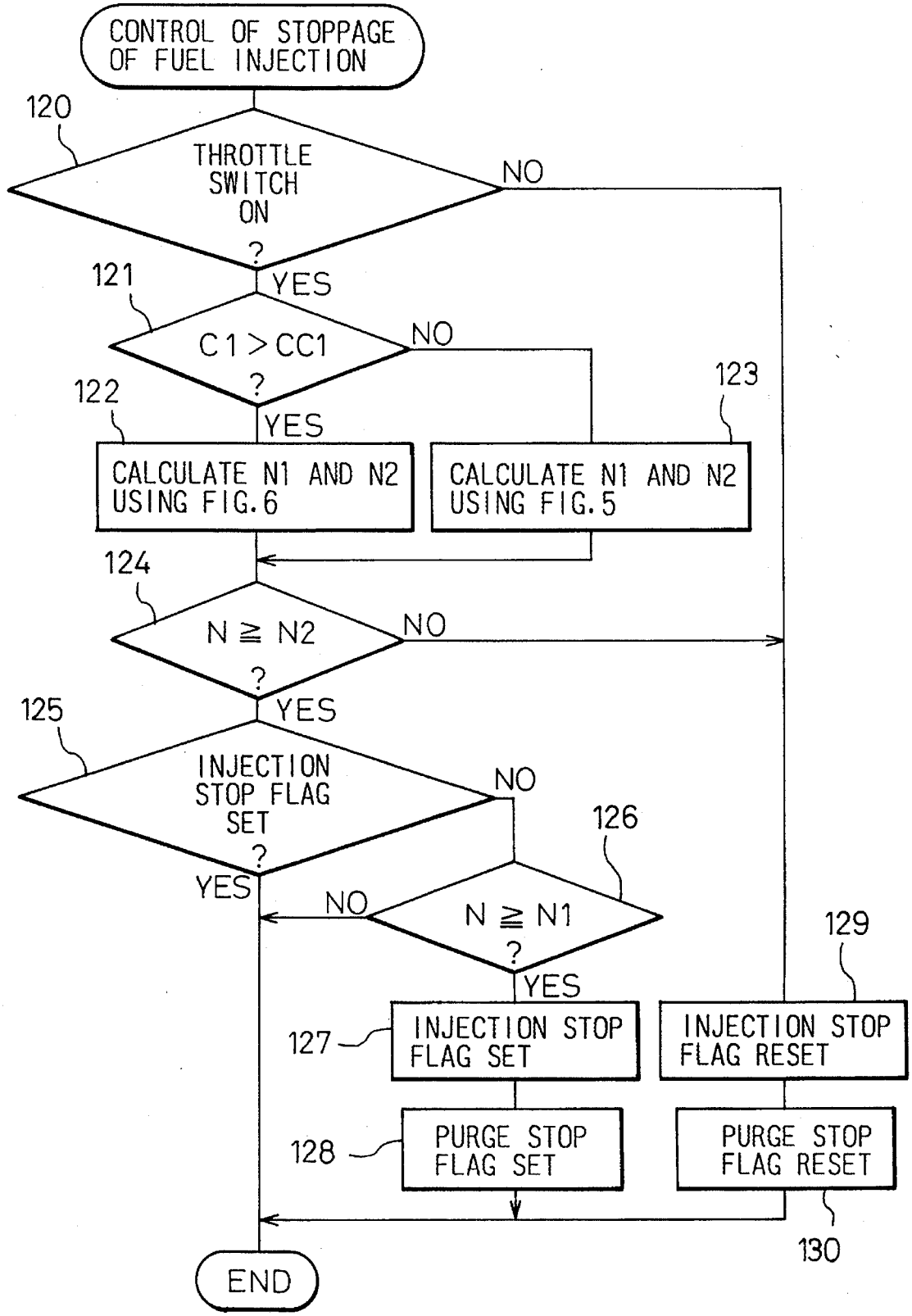
FIG. 11 is a flowchart for executing a control of a stoppage of a fuel injection, according to the second embodiment.

FIG. 11 illustrates a routine for controlling the stoppage of the fuel injection, according to this embodiment. This routine is executed in, for example, the main routine of the engine.

Referring to FIG. 11, first, in step 120, it is determined whether the throttle switch 28 is turned ON. If the throttle switch 28 is turned ON, the routine goes to step 121, where it is determined whether the counter value C1, which represents the purge period, is larger than a predetermined value CC1. If C1>CC1, the engine operating period is judged to be longer than the predetermined period, and the routine goes to step 122, where the first and the second reference speeds N1 and N2 are calculated using the map shown in FIG. 6, in accordance with the change (FGPG−1). Then, the routine goes to step 124.

Contrarily, if C1≦CC1 in step 121, the engine operating period is judged to be shorter than the predetermined period, and the routine goes to step 123, where the first and the second reference speeds N1 and N2 are calculated using the map shown in FIG. 5, in accordance with the engine cooling water temperature THW. Then, the routine goes to step 124.

In step 124, it is determined whether the current engine speed N is larger than the second reference speed N2 obtained in step 122 or 123. If N≧N2, the routine goes to step 125, where it is determined whether the injection stop flag is set. If the injection stop flag is reset, the routine goes to step 126, where it is determined whether the engine speed N is higher than the first reference speed N1 obtained in step 122 or 123. If N≧N1, the routine goes to step 127, where the injection stop flag is set. In following step 128, the purge stop flag is also set. Namely, the fuel injection and the purging operation are stopped. Then, the processing cycle is ended.

Contrarily, if N<N1 in step 126, the processing cycle is ended. Namely, both flags remain reset, and the fuel injection and the purging operation are continuously carried out.

On the other hand, if the injection stop flag is set in step 125, the processing cycle is ended. Namely, the fuel injection and the purging operation are continuously stopped.

If the switch 28 is turned OFF in step 120, or if N<N2 in step 124, the routine goes to steps 129 and 130. In steps 129 and 130, the injection stop flag and the purge stop flag are both reset. Namely, the fuel injection and the purging operation are carried out.

In the first and the second embodiment, the first and the second reference speeds N1 and N2 are stored, in advance, in the form of the map as shown in FIG. 6. Alternatively, the reference speeds may be, first, obtained regardless the storing capacity of the canister 11 using, for example, the map shown in FIG. 5, and then, are corrected by correction coefficients, to thereby make the selected condition range narrower when the storing capacity of the canister 11 becomes lower. The others are same as the first embodiment mentioned above, and thus the explanations thereof are omitted.

Next, a third embodiment of the present invention will be explained.

When the fuel injection time TAU calculated the above-mentioned equation is very short, it may be difficult for the fuel injector 4 to actuate properly, and thus, the actual amount of fuel injected by the fuel injector 4 may deviate from the target amount. Therefore, in this embodiment, the fuel injection is stopped when the calculated fuel injection time TAU is very short. In other wards, it is determined that the engine operating condition is within the selected range in which the fuel injection is to be stopped, when TAU is very short. In this case, it need be determined whether the engine operating condition is within the selected condition range, taking the adsorbing capacity of the canister 11 into consideration.

Figure 12:
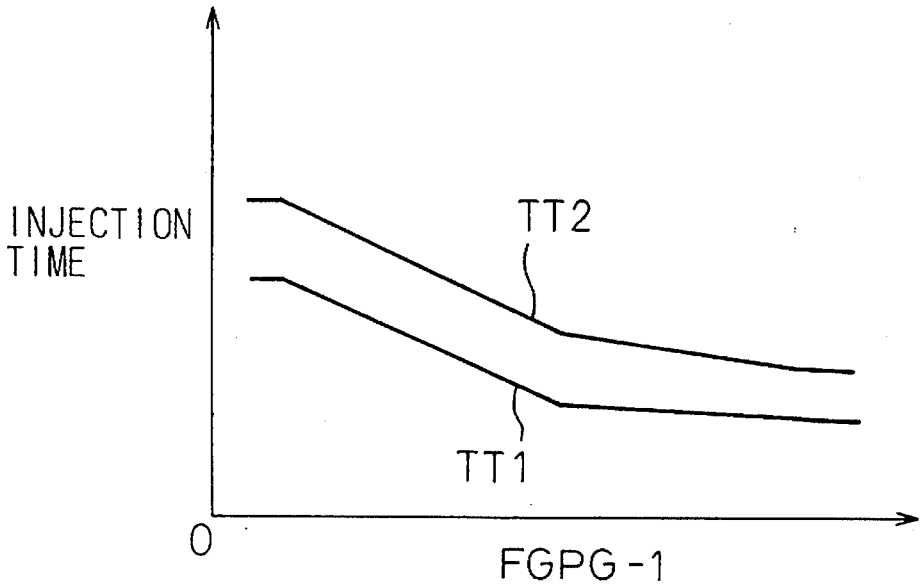
FIG. 12 is a diagram illustrating first and second reference injection times, as a function of a change in a fuel vapor concentration coefficient.

In this embodiment, it is determined whether the engine operating condition is within the selected range, by comparing the fuel injection time TAU with a first reference injection time TT1. Namely, it is determined that the fuel injection and the purging operation are to be stopped, when the fuel injection time TAU is shorter than the first reference injection time TT1. The first reference time TT1 becomes shorter, when the change in the fuel vapor concentration coefficient FGPG−1 becomes larger, as shown in FIG. 12. Accordingly, the selected condition range becomes narrower, when the adsorbing capacity of the canister 11 becomes lower. This results in preventing fuel vapor from being discharged into the outside air without being stored in the canister 11.

During the stoppage of the fuel injection and the purging operation, when the engine speed N is lower than a third reference speed N3, which is explained in detail hereinafter, the fuel injection and the purging operation are restarted.

Comparing the fuel injection time TAU with the first reference time TT1 is performed when the engine speed N is higher than or equal to the third reference speed N3.

Generally, the fuel injection time TAU is shortened rapidly when, for example, the engine is rapidly decelerated. In this condition, the fuel injection time TAU may be temporarily shorter than the first reference time TT1, and therefore, the stoppage of the fuel injection may be carried out undesirably frequently. This may deteriorate the drivability.

Therefore, in this embodiment, a second reference fuel injection time TT2 is introduced, and comparing the fuel injection time TAU with the first reference time TT1 is performed, after the injection time TAU has been kept below the second reference time TT2 for a selected period. Namely, first, the fuel injection time TAU is compared with the second reference time TT2 if the engine speed N is higher than the third reference speed N3. If TAU has been shorter than the second reference time TT2 for the selected period, TAU is compared with the first reference time TT1. If TAU is shorter than the first reference time TT1, the fuel injection is stopped. At this time, the purging operation is also stopped. Then, when the engine speed N is lower than the third reference speed N3, the fuel injection and the purging operation are restarted.

The second reference time TT2 is set to become shorter when the adsorbing capacity of the canister 11 becomes lower, to thereby make the selected condition range narrower. Namely, the second reference time TT2 is set to become shorter when the change in the fuel vapor concentration coefficient FGPG−1 becomes larger, as shown in FIG. 12. The reference times TT1 and TT2 are stored in advance in the ROM 22 in the form of the map shown in FIG. 12.

Figure 13:
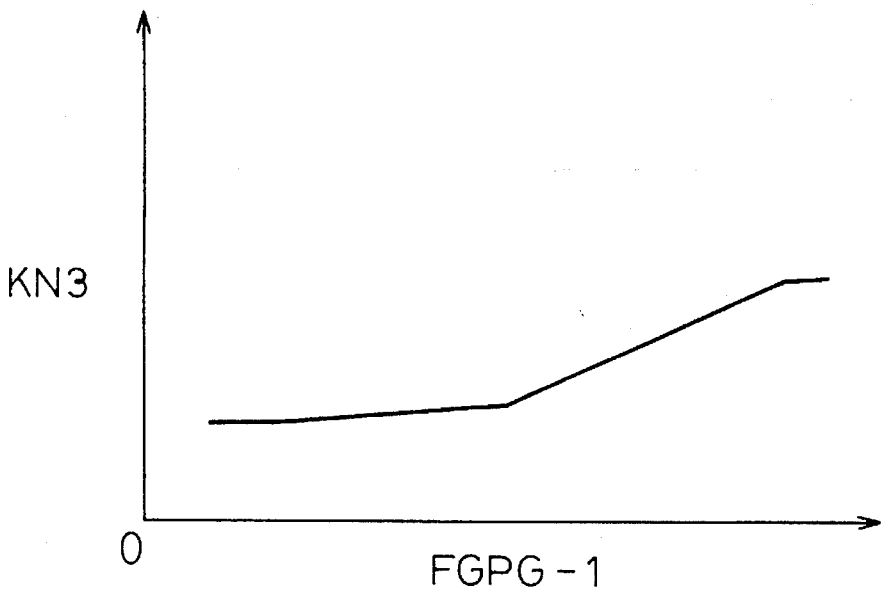
FIG. 13 is a diagram illustrating a changing coefficient, as a function of a change in a fuel vapor concentration coefficient.

The third reference speed N3 is set to become larger when the adsorbing capacity of the canister 11 becomes lower, to thereby make the selected condition range narrower. The third reference speed N3 is obtained as a product of a constant N0 and a changing coefficient KN3. The changing coefficient KN3 becomes smaller when the change in the fuel vapor concentration coefficient FGPG–1 becomes larger, as shown in FIG. 13. The changing coefficient KN3 is stored in advance in the ROM 22 in the form of the map shown in FIG. 13.

Figure 14:
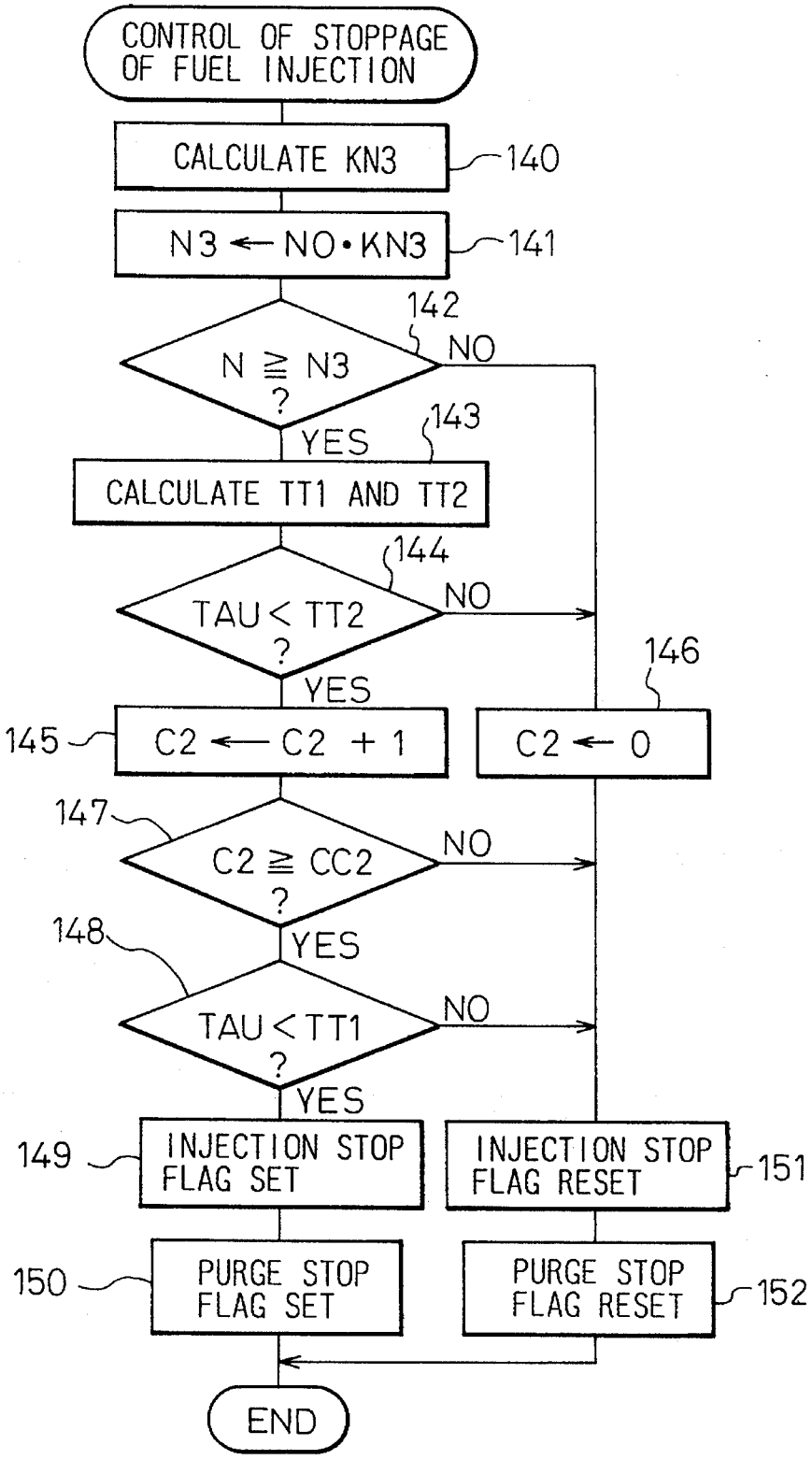
FIG. 14 is a flowchart for executing a control of a stoppage of a fuel injection, according to the third embodiment.

FIG. 14 illustrates a routine for controlling the stoppage of the fuel injection, according to the third embodiment. This routine is executed in, for example, the main routine of the engine.

Referring to FIG. 14, first, in step 140, the changing coefficient KN3 is calculated using the map shown in FIG. 13. In following step 141, the third reference speed N3 is calculated using the following equation:

$$N3=N0\cdot KN3$$

In following step 142, it is determined whether the engine speed N is higher or equal to the third reference speed N3. If N≧N3, the routine goes to step 143, where the first and the second reference times TT1 and TT2 are calculated using the map shown in FIG. 12. In following step 144, it is determined whether the fuel injection time TAU is shorter than the second reference time TT2. If TAU<TT2, the routine goes to step 145, where a second counter value C2, which represents a period for which the fuel injection time TAU is shorter than the second reference time TT2, is incremented by one. Then, the routine goes to step 147.

If N<N3 in step 142, or if TAU≧TT2 in step 144, the routine goes to step 146, where the second counter value C2 is made zero. Then, the routine goes to steps 151 and 152.

In step 147, it is determined whether the second counter value C2 is larger or equal to a selected value CC2. If C2≧CC2, it is judged that the fuel injection time TAU has been shorter than TT2 for the selected period and then the routine goes to step 148, where it is determined whether the fuel injection time TAU is shorter than the first reference time TT1. If TAU<TT1, the routine goes to steps 149 and 150. In step 149, the injection stop flag is set, and in step 150, the purge stop flag is also set. Namely, the fuel injection and the purging operation are stopped. Then, the processing cycle is ended.

If C2<CC2 in step 147, or if TAU≧TT1 in step 148, the routine goes to steps 151 and 152. In step 151, the injection stop flag is reset, and in step 152, the purge stop flag is also reset. Namely, the fuel injection and the purging operation are restarted.

In the third embodiment, the first and the second reference injection times TT1 and TT2 are stored in advance in the form of the map as shown in FIG. 12. Alternatively, the reference injection times may be, first, obtained regardless of the storing capacity of the canister 11, and then, are corrected by correction coefficients, to thereby make the selected condition range narrower when the storing capacity of the canister 11 becomes lower. The others are same as the first embodiment mentioned above, and thus the explanations thereof are omitted.

Next, a fourth embodiment of the present invention will be explained.

In this embodiment, it is determined whether the engine operating condition is within the selected condition range, by comparing a changed engine speed with predetermined reference speeds. Namely, the actual engine speed N is changed to become lower when the adsorbing capacity of the canister 11 becomes lower, and it is determined that the engine operating condition is within the selected range when the changed engine speed NN is higher than the first reference speed N1. During the stoppage of the fuel injection and the purging operation, it is determined that the engine operating condition range is without the selected condition range when the changed engine speed NN is lower than the second reference speed N2, which is lower than the first reference speed N1. Accordingly, the selected condition range in which the fuel injection and the purging operation are to be stopped becomes narrower when the adsorbing capacity of the canister 11 becomes lower.

The first and the second reference speeds N1 and N2 are constant in this embodiment. Alternatively, the reference speeds N1 and N2 may be set in accordance with the adsorbing capacity of the canister 11, for example, using the map shown in FIG. 6.

Figure 15:
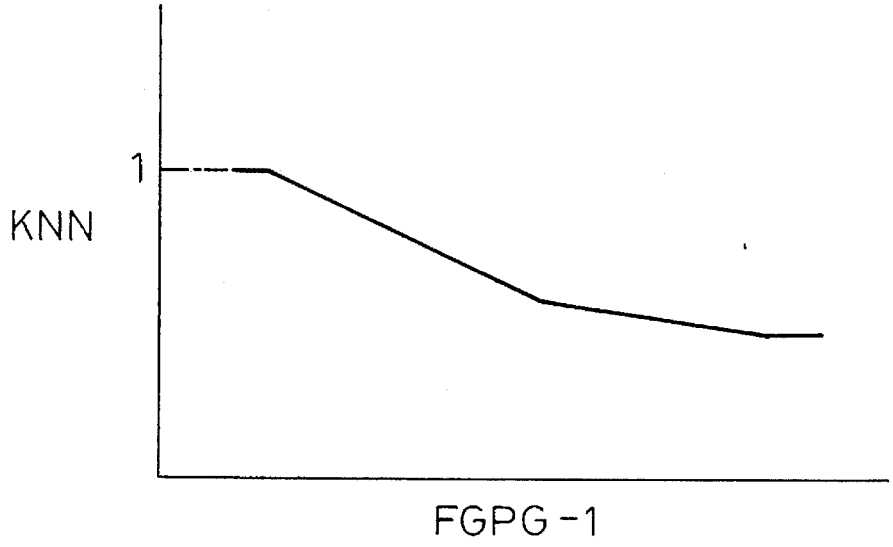
FIG. 15 is a diagram illustrating a changing coefficient, as a function of a change in a fuel vapor concentration coefficient.

The changed engine speed NN is obtained as a product of the actual engine speed N and a changing coefficient KNN (<1). This changing coefficient KNN is set to become lower when the adsorbing capacity of the canister 11 becomes lower, as shown in FIG. 15. Therefore, the changed engine speed NN becomes lower when FGPG–1 becomes larger, for the constant actual speed N. This coefficient KNN is stored in advance in the ROM 22 in the form of the map shown in FIG. 15.

Figure 16:
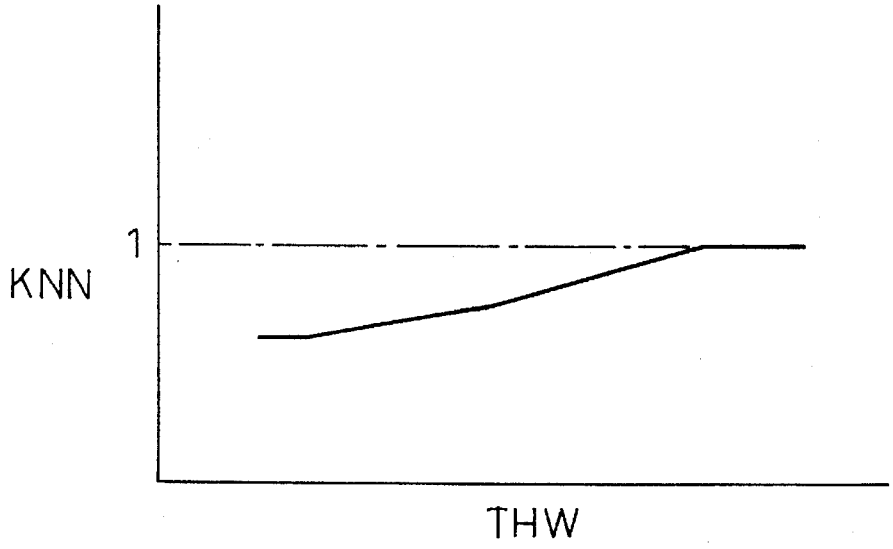
FIG. 16 is a diagram illustrating a changing coefficient, as a function of an engine temperature.

When the adsorbing capacity of the canister 11 is very low, namely, when the change in the fuel vapor concentration coefficient FGPG–1 is smaller than the predetermined value FF, it is determined whether the engine operating condition is within the selected condition range, on the basis of the engine cooling water temperature THW. Namely, the engine speed N is changed by the changing coefficient KNN, which is set as a function of the engine cooling water temperature THW, and then, the changed engine speed NN is compared with the reference speeds N1 and N2. The changing coefficient KNN in this case is set to become smaller when the temperature THW becomes lower, as shown in FIG. 16. Therefore, the changed engine speed NN becomes lower when THW becomes lower, for the constant actual speed N. This results in making the selected condition range narrower when the temperature THW becomes lower. This changing coefficient KNN is stored in advance in the ROM 22 in the form of the map shown in FIG. 16.

Contrarily, when the change in the fuel vapor concentration coefficient FGPG–1 is larger than the predetermined value FF, the changing coefficient KNN is determined in accordance with FGPG–1.

Further, as in the first and the second embodiment mentioned above, the fuel injection and the purging operation is continuously carried out, or is restarted, when the throttle switch 28 is turned OFF.

Figure 17:
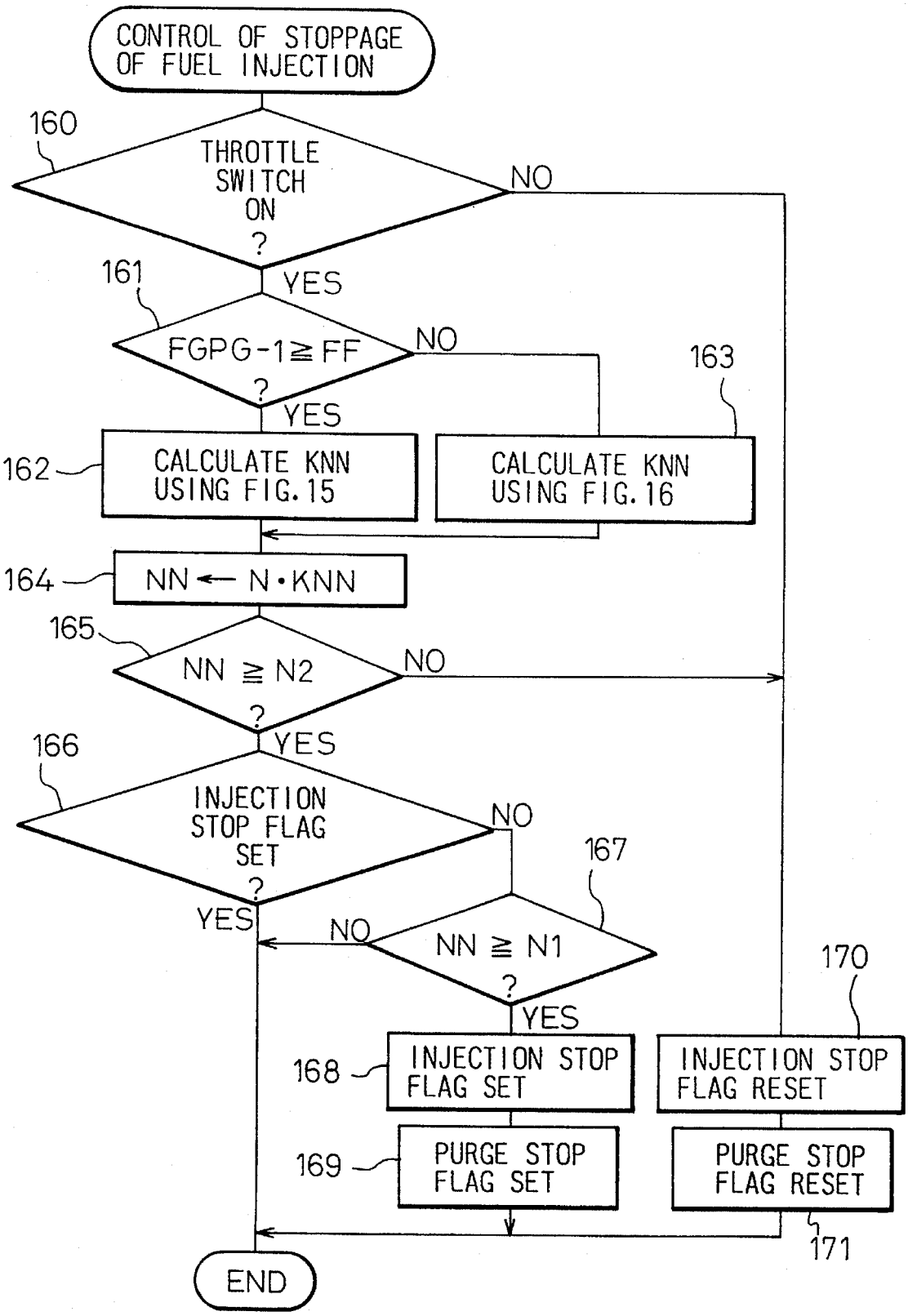
FIG. 17 is a flowchart for executing a control of a stoppage of a fuel injection, according to the fourth embodiment.

FIG. 17 illustrates a routine for controlling the stoppage of the fuel injection. This routine is executed in, for example, the main routine of the engine.

Referring to FIG. 17, first, in step 160, it is determined whether the throttle switch 28 is turned ON. If the throttle switch 28 is turned ON, the routine goes to step 161, and if the switch 28 is turned OFF, the routine jumps to steps 170 and 171. In step 161, it is determined whether the change in the fuel vapor concentration coefficient FGPG–1 is larger than or equal to the predetermined value FF. If FGPG–1≧FF, the routine goes to step 162, where the changing coefficient KNN is calculated using the map shown in FIG. 15. Namely, the changing coefficient KNN is calculated in accordance with the adsorbing capacity of the canister 11. Then, the routine goes to step 164. Contrarily, if FGPG–1<FF in step 161, the routine goes to step 163, where the changing coefficient KNN is calculated using the map shown in FIG. 16. Namely, the changing coefficient KNN is calculated in accordance with the engine cooling water temperature THW. Then, the routine goes to step 164.

In step 164, the changed engine speed NN is calculated using the following equation:

$$NN=N\cdot KNN$$

In following step 165, it is determined whether the changed engine speed NN is larger than or equal to the second reference speed N2 (<N1). If NN≧N2, the routine goes to step 166. If NN<N2, the routine jumps to steps 170 and 171. In step 166, it is determined whether the injection stop flag is set. If the injection stop flag is set, the processing cycle is ended. Namely, the fuel injection and the purging operation are continuously stopped.

If the fuel injection flag is reset in step 166, the routine goes to step 167, where it is determined whether the changed engine speed NN is higher than or equal to the first reference speed N1. If NN≧N1, the routine goes to steps 168 and 169. If NN<N1, the routine goes to steps 170 and 171.

In step 168, the injection stop flag is set, and in step 169, the purge stop flag is also set. Namely, the fuel injection and the purging operation are stopped. Then, the processing cycle is ended.

Contrarily, in steps 170 and 171, the injection stop flag and the purge stop flag are both reset. Namely, the fuel injection and the purging operation are continuously carried out or are restarted. The others are same as the first embodiment mentioned above, and thus the explanations thereof are omitted.

Next, a fifth embodiment of the present invention will be explained.

This embodiment differs from the fourth embodiment mentioned above, in the point that it is judged whether the adsorbing capacity of the canister 11 is very low on the basis of the engine operating period, as in the second embodiment. Namely, the changing coefficient KNN is calculated in accordance with the adsorbing capacity of the canister 11 using the map shown in FIG. 15, when the engine operating period is shorter than the predetermined period and is calculated in accordance with the engine cooling water temperature, using the map shown in FIG. 16, when the engine operating period is longer than the predetermined period.

Figure 18:
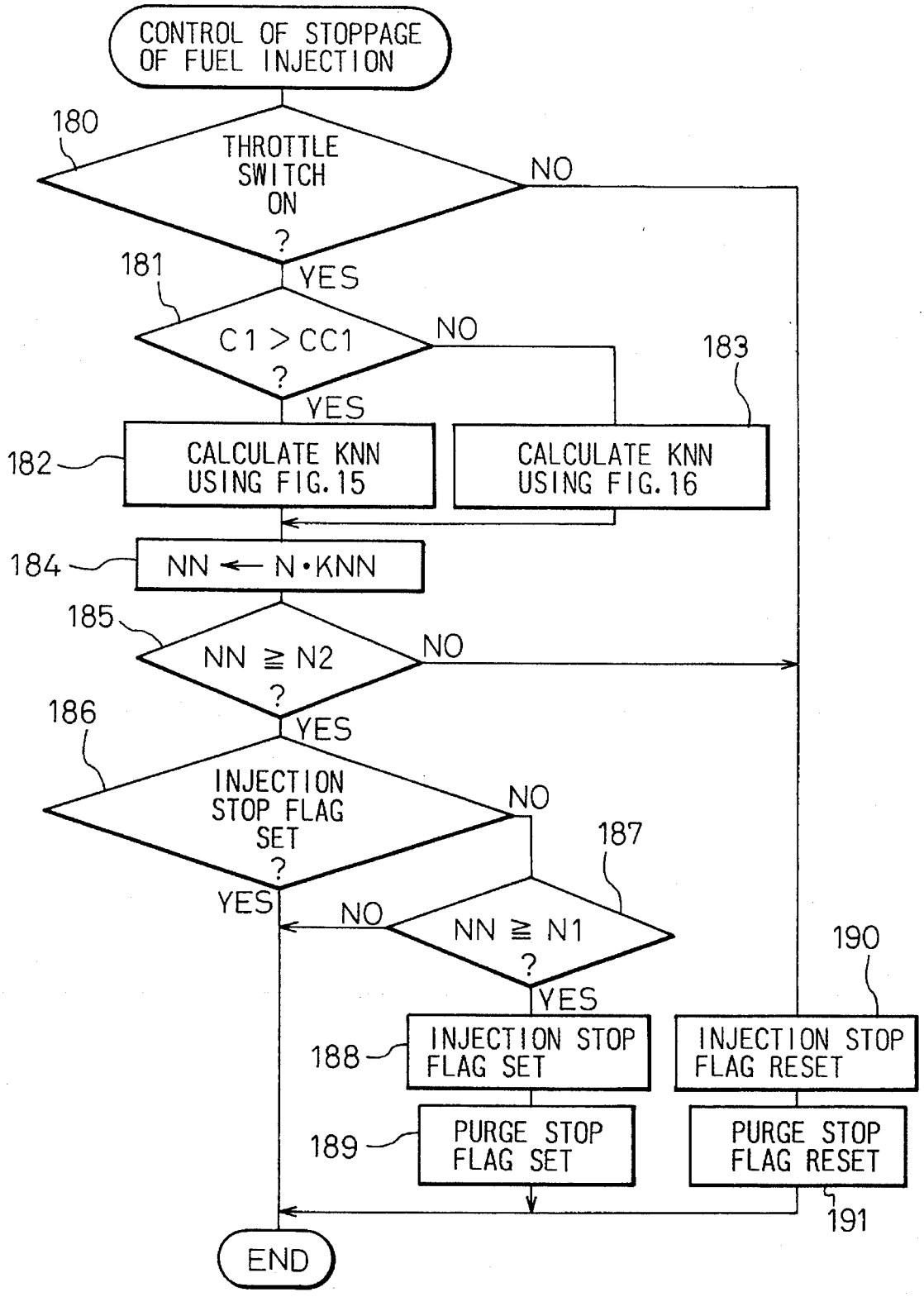
FIG. 18 is a flowchart for executing a control of a stoppage of a fuel injection, according to the fifth embodiment.

FIG. 18 illustrates a routine for controlling the stoppage of the fuel injection, according to this embodiment. This routine is executed in, for example, the main routine of the engine.

Referring to FIG. 18, first, in step 180, it is determined whether the throttle switch 28 is turned ON. If the throttle switch 28 is turned ON, the routine goes to step 181, where it is determined whether the counter value C1, which represents the purge period, is larger than the predetermined value CC1. If C1>CC1, the engine operating period is judged to be longer than the predetermined period and the routine goes to step 182 where the changing coefficient KNN is calculated using the map shown in FIG. 15. Namely, the changing coefficient KNN is calculated in accordance with the adsorbing capacity of the canister 11. Then, the routine goes to step 184. Contrarily, if C≦CC1 in step 181, the engine operating period is judged to be shorter than the predetermined period, and the routine goes to step 183, where the changing coefficient KNN is calculated using the map shown in FIG. 16. Namely, the changing coefficient KNN is calculated in accordance with the engine cooling water temperature THW. Then, the routine goes to step 184.

In step 184, the changed engine speed NN is calculated using the following equation:

$$NN=N\cdot KNN$$

In following step 185, it is determined whether the changed engine speed NN is larger than or equal to the second reference speed N2 (<N1). If NN≧N2, the routine goes to step 186. If NN<N2, the routine jumps to steps 190 and 191. In step 186, it is determined whether the injection stop flag is set. If the injection stop flag is set, the processing cycle is ended. Namely, the fuel injection and the purging operation are continuously stopped.

If the fuel injection flag is reset in step 186, the routine goes to step 187, where it is determined whether the changed engine speed NN is higher than or equal to the first reference speed N1. If NN≧N1, the routine goes to steps 188 and 189. If NN<N1, the routine goes to steps 190 and 191.

In step 188, the injection stop flag is set, and in step 189, the purge stop flag is also set. Namely, the fuel injection and the purging operation are stopped. Then, the processing cycle is ended.

Contrarily, in steps 190 and 191, the injection stop flag and the purge stop flag are both reset. Namely, the fuel injection and the purging operation are continuously carried out or are restarted. The others are same as the first embodiment mentioned above, and thus the explanations thereof are omitted.

Next, a sixth embodiment of the present invention will be explained.

In this embodiment, it is determined whether the engine operating condition is within the selected condition range, by comparing a changed fuel injection time with predetermined reference injection times. Namely, first, the calculated fuel injection time TAU is changed to become larger when the adsorbing capacity of the canister 11 becomes lower. Then, if the changed injection time TTAU has been shorter than the second reference injection time TT2 for the predetermined period, the changed injection time TTAU is compared with the first reference injection time TT1. When the changed injection time TTAU is shorter than the first reference injection time TT1, it is determined that the engine operating condition is within the selected range. Accordingly, the selected condition range in which the fuel injection and the purging operation are to be stopped becomes narrower, when the adsorbing capacity of the canister 11 becomes lower.

During the stoppage of the fuel injection and the purging operation, it is determined that the engine operating condition range is outside the selected condition range when the engine speed N is lower than a reference speed N4.

The first and the second reference injection times TT1 and TT2 and the reference speed N4 are constant, in this embodiment. Alternatively, the reference injection times TT1 and TT2 and the reference speed N4 may be set in accordance with the adsorbing capacity of the canister 11, for example, using the maps shown in FIGS. 12 and 13, respectively.

The changed fuel injection time TTAU is obtained as a product of the fuel injection time TAU calculated in the routine shown in FIG. 10 and a changing coefficient (>1). While any coefficient can be used as the changing coefficient, the changing coefficient in this embodiment is $\{1+(FGPG-1)\}\cdot b$, where b is a constant. This coefficient becomes larger when the adsorbing capacity of the canister 11 becomes lower, and therefore, the changed engine injection time TTAU becomes longer when FGPG−1 becomes larger, for the constant calculated injection time TAU.

Figure 19:
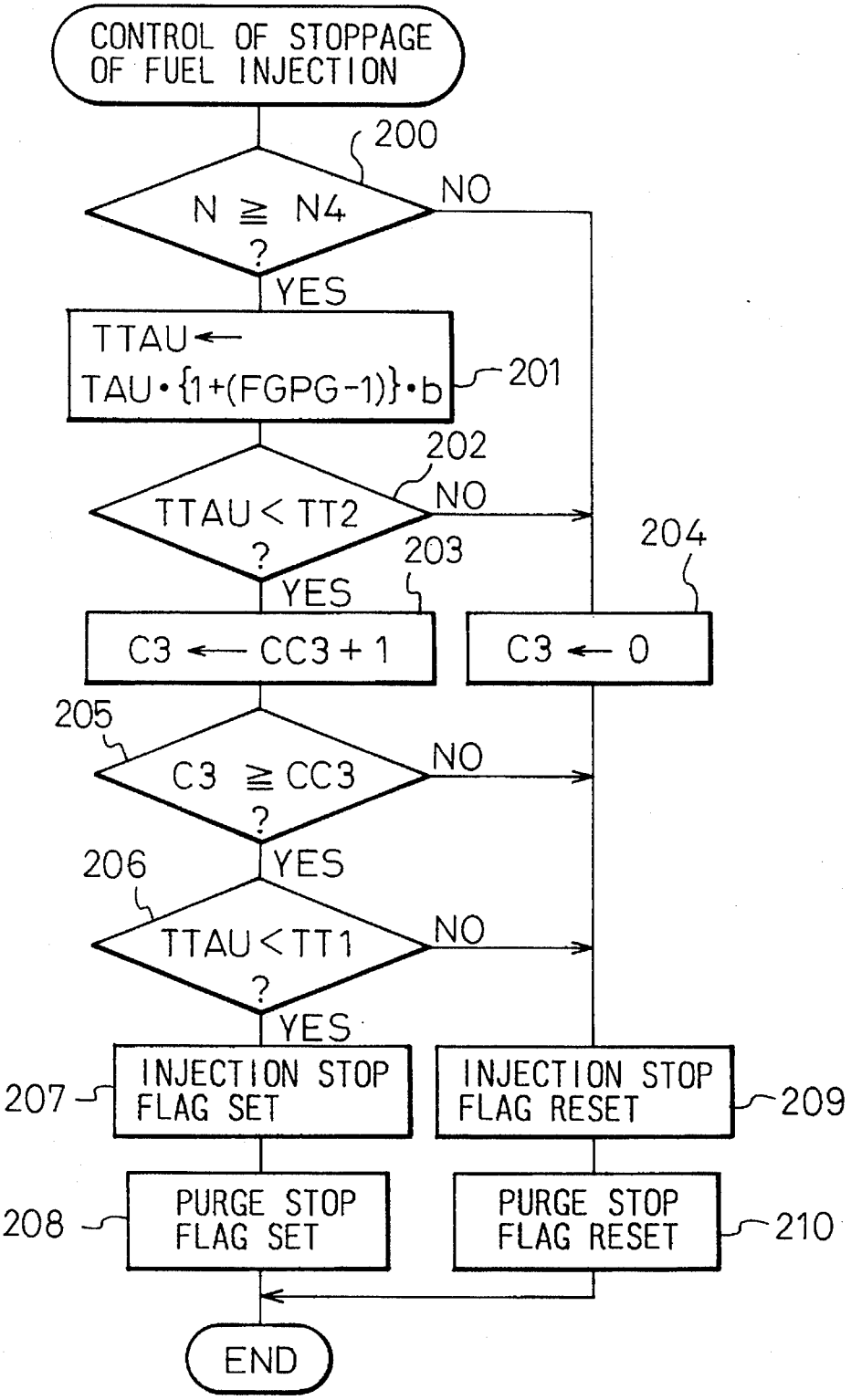
FIG. 19 is a flowchart for executing a control of a stoppage of a fuel injection, according to the sixth embodiment.

FIG. 19 illustrates a routine for controlling the stoppage of the fuel injection, according to the third embodiment. This routine is executed in, for example, the main routine of the engine.

Referring to FIG. 19, first, in step 200, it is determined whether the actual engine speed N is higher or equal to the fourth reference speed N4. If N≧N4, the routine goes to step 201, where the changed fuel injection time TTAU is calculated using the following equation:

$$TTAU=TAU\cdot\{1+(FGPG-1)\}\cdot b$$

In following step 202, it is determined whether the changed injection time TTAU is shorter than the second reference time TT2. If TTAU<TT2, the routine goes to step 203, where a third counter value C3, which represents a period for which the changed injection time TTAU has been shorter than the second reference time TT2, is incremented by one. Then, the routine goes to step 205.

If N<N4 in step 200, or if TAU≧TT2 in step 202, the routine goes to step 204, where the third counter value C3 is made zero. Then, the routine goes to steps 209 and 210.

In step 205, it is determined whether the third counter value C3 is larger than or equal to a selected value CC3. If C3≧CC3, it is judged that the calculated injection time TTAU has been shorter than TT2 for the selected period and, then, the routine goes to step 206, where it is determined whether the calculated injection time TTAU is shorter than the first reference time TT1. If TTAU<TT1, the routine goes to steps 207 and 208. In step 207, the injection stop flag is set, and in step 208, the purge stop flag is also set. Namely, the fuel injection and the purging operation are stopped. Then, the processing cycle is ended.

If C3<CC3 in step 205, or if TTAU≧TT1 in step 206, the routine goes to steps 209 and 210. In step 209, the injection stop flag is reset, and in step 210, the purge stop flag is also reset. Namely, the fuel injection and the purging operation are continuously carried out or are restarted. The others are same as the first embodiment mentioned above, and thus the explanations thereof are omitted.

In the embodiments mentioned above, the selected condition range in which the fuel injection and the purging operation are to be stopped is set to become narrower, as the storing capacity of the canister 11 generally becomes lower. Alternatively, the selected condition range may be set to be a relatively narrower range when the storing capacity is lower than a threshold, and be a relatively broader range when the storing capacity is higher than the threshold.

Further, an opening sensor for sensing the opening of the throttle valve may be provided, and it may be determined that the engine operating condition is within the selected range when the opening of the throttle valve is smaller than a reference opening, and that the engine operating condition is outside of the selected range when the opening of the throttle valve is larger than the reference opening. In this case, the reference opening may be set to become smaller when the storing capacity of the canister 11 becomes lower. Alternatively, the actual opening of the throttle valve may be changed so that it becomes larger when the storing capacity of the canister 11 becomes lower, and it may be determined that the engine operating condition is within the selected range when the opening of the throttle valve is smaller than a reference opening, and that the engine operating condition is outside of the selected range when the changed opening of the throttle valve is larger than the reference opening.

According to the present invention, it is possible to provide a fuel supply control device capable of preventing fuel vapor from being discharged into the outside air, while reducing fuel consumption.

While the invention has been described by reference to specific embodiments chosen for purposes of illustration, it should be apparent that numerous modifications could be made thereto by those skilled in the art without departing from the basic concept and scope of the invention.

I claim:

1. A fuel supply control device for an engine having an intake passage with a throttle valve therein, the device comprising:

a fuel injector for feeding pressurized fuel to the engine;

a canister for temporarily storing fuel vapor therein;

a purge passage connecting the canister to the intake passage downstream of the throttle valve;

purging means for purging fuel vapor stored in the canister to the intake passage via the purge passage;

storing capacity calculating means for calculating a storing capacity of the canister;

engine operating condition parameter obtaining means for obtaining at least one engine operating condition parameter representing the engine operating condition;

reference parameter calculating means for calculating at least one reference parameter, corresponding to the engine operating condition parameter, on the basis of the storing capacity of the canister;

determining means for determining whether an engine operating condition is within a selected condition range in which a fuel injection of the fuel injector is to be stopped, by comparing the at least one engine operating condition parameter with the corresponding reference parameter;

fuel injection control means for controlling the fuel injector to stop the fuel injection when the determining means determines that the engine operating condition is within the selected condition range, and to allow the fuel injection when the determining means determines that the engine operating condition is outside the selected condition range; and purge control means for controlling the purge means to stop a purging operation of the purge means when the fuel injection control means stops the fuel injection, and to allow the purging operation when the fuel injection control means allows the fuel injection, wherein the reference parameter calculating means calculates the reference parameter to make the selected condition range narrower when the storing capacity of the canister becomes lower.

2. A fuel supply control device according to claim 1, wherein the engine operating condition parameter obtaining means obtains an engine speed, wherein the reference parameter calculating means calculates a first reference speed, and wherein the determining means determines that the engine operating condition is within the selected condition range when the engine speed is higher than the first reference speed.

3. A fuel supply control device according to claim 2, wherein the first reference speed becomes higher when the storing capacity of the canister becomes lower.

4. A fuel supply control device according to claim 2, wherein the reference parameter calculating means further calculates a second reference speed which is lower than the first reference speed, and wherein the determining means determines that the engine operating condition becomes outside the selected condition range when the engine speed becomes lower than the second reference speed.

5. A fuel supply control device according to claim 4, wherein the second reference speed becomes higher when the storing capacity of the canister becomes lower.

6. A fuel supply control device according to claim 2, wherein the engine operating condition parameter obtaining means further obtains an opening of the throttle valve, wherein the reference parameter calculating means further calculates a reference opening, and wherein the determining means determines that the engine operating condition is within the selected condition range when the engine speed is higher than the first reference speed and when the opening of the throttle valve is lower than or equal to the reference opening.

7. A fuel supply control device according to claim 6, wherein the reference parameter calculating means further calculates a second reference speed which is lower than the first reference speed, and wherein the determining means determines that the engine operating condition becomes outside the selected condition range when the engine speed becomes lower than the second reference speed, or when the opening of the throttle valve becomes larger than the reference opening.

8. A fuel supply control device according to claim 1, the device further comprising fuel amount calculating means for calculating an amount of fuel fed by the fuel injector, wherein the engine operating condition parameter obtaining means obtains the amount of fuel fed by the fuel injector, wherein the reference parameter calculating means calculates a first reference amount, and wherein the determining means determines that the engine operating condition is within the selected condition range when the amount of fuel fed by the fuel injector is smaller than the first reference amount.

9. A fuel supply control device according to claim 8, wherein the first reference amount becomes smaller when the storing capacity of the canister becomes lower.

10. A fuel supply control device according to claim 8, wherein the reference parameter calculating means further calculates a second reference amount which is larger than the first reference amount, and wherein the amount of fuel fed by the fuel injector is compared with the first reference amount when the amount of fuel fed by the fuel injector is kept smaller than the second reference amount for a predetermined period.

11. A fuel supply control device according to claim 10, wherein the second reference amount becomes smaller when the storing capacity of the canister becomes lower.

12. A fuel supply control device according to claim 8, wherein the engine operating condition parameter obtaining means further obtains an engine speed, wherein the reference parameter calculating means further calculates a reference speed, and wherein the determining means determines that the engine operating condition is within the selected condition range when the amount of fuel fed by the fuel injector is smaller than the first reference amount and when the engine speed is higher than the reference speed.

13. A fuel supply control device according to claim 12, wherein the determining means determines that the engine operating condition becomes outside the selected condition range when the amount of fuel fed by the fuel injector becomes larger than the first reference amount, or when the engine speed becomes lower than the reference speed.

14. A fuel supply control device according to claim 1, wherein the reference parameter has a basic value, wherein the reference parameter calculating means changes the basic value by a changing coefficient to make the selected condition range narrower when the storing capacity of the canister becomes lower, and wherein the determining means determines whether the engine operating condition is within the selected condition range by comparing the engine operating condition parameter with the changed reference parameter.

15. A fuel supply control device according to claim 1, the device further comprising fuel vapor amount calculating means for calculating an amount of fuel vapor fed into the engine, wherein the storing capacity calculating means calculates the storing capacity of the canister on the basis of the amount of fuel vapor fed into the engine.

16. A fuel supply control device according to claim 15, the fuel vapor amount calculating means comprising fuel vapor concentration coefficient calculating means for calculating a fuel vapor concentration coefficient representing a concentration of fuel vapor in air fed into the engine, wherein the storing capacity calculating means calculates the storing capacity of the canister on the basis of the fuel vapor concentration coefficient.

17. A fuel supply control device according to claim 16, the engine further having an exhaust passage, the device further comprising an air-fuel ratio sensor arranged in the exhaust passage for detecting an air-fuel ratio, and fuel amount correcting means for correcting an amount of fuel to be fed by the fuel injector by a feedback correction coefficient to make the air-fuel ratio equal to a target air-fuel ratio, the feedback correction coefficient being calculated in accordance with the output signals of the air-fuel ratio sensor and having a reference value around which the feedback correction coefficient deviates, wherein the fuel vapor concentration coefficient calculating means calculates the fuel vapor concentration coefficient on the basis of the deviation of the feedback correction coefficient from the reference value thereof, which deviation is caused when the purging operation is carried out.

18. A fuel supply control device according to claim 1, wherein the reference parameter calculating means calculates the at least one reference parameter on the basis of the storing capacity of the canister, when the storing capacity of the canister is lower than a predetermined value.

19. A fuel supply control device according to claim 18, the device further comprising a temperature sensor for sensing a temperature representing an engine temperature, wherein the reference parameter calculating means calculates the at least one reference parameter on the basis of the temperature representing the engine temperature, regardless the storing capacity of the canister, when the storing capacity of the canister is higher than the predetermined value.

20. A fuel supply control device according to claim 19, wherein the reference parameter calculating means calculates the at least one reference parameter to make the selected condition range narrower when the temperature representing the engine temperature becomes lower, when the storing capacity of the canister is higher than the predetermined value.

21. A fuel supply control device according to claim 19, wherein the temperature representing an engine temperature is a temperature of the engine cooling water.

22. A fuel supply control device for an engine having an intake passage with a throttle valve, the device comprising:

a fuel injector for feeding pressurized fuel to the engine;

a canister for temporarily storing fuel vapor therein;

a purge passage connecting the canister to the intake passage downstream of the throttle valve;

purging means for purging fuel vapor stored in the canister to the intake passage via the purge passage;

storing capacity calculating means for calculating a storing capacity of the canister;

engine operating condition parameter obtaining means for obtaining at least one engine operating condition parameter representing an engine operating condition;

parameter changing means for changing the at least one engine operating condition parameter on the basis of the storing capacity of the canister;

reference parameter calculating means for calculating at least one reference parameter corresponding to the engine operating condition parameter;

determining means for determining whether the engine operating condition is within a selected range in which a fuel injection of the fuel injector is to be stopped, by comparing the at least one changed engine operating condition parameter with the corresponding reference parameter;

fuel injection control means for controlling the fuel injector to stop the fuel injection when the determining means determines that the engine operating condition is within the selected condition range, and to allow the fuel injection when the determining means determines that the engine operating condition is outside the selected condition range; and purge control means for controlling the purge means to stop a purging operation of the purge means when the fuel injection control means stops the fuel injection, and to allow the purging operation when the fuel injection control means allows the fuel injection, wherein the parameter changing means changes the at least one engine operating condition parameter to make the selected condition range narrower when the storing capacity of the canister becomes lower.

23. A fuel supply control device according to claim 22, wherein the engine operating condition parameter obtaining means obtains an engine speed, wherein the parameter changing means changes the engine speed, wherein the reference parameter calculating means calculates a first reference speed, and wherein the determining means determines that the engine operating condition is within the selected condition range when the changed engine speed is higher than the first reference speed.

24. A fuel supply control device according to claim 23, wherein the parameter changing means changes the engine speed by a changing coefficient, the changing coefficient becoming smaller to thereby make the changed engine speed lower when the storing capacity of the canister becomes lower.

25. A fuel supply control device according to claim 23, wherein the reference parameter calculating means further calculates a second reference speed which is lower than the first reference speed, and wherein the determining means determines that the engine operating condition becomes outside the selected condition range when the changed engine speed becomes lower than the second reference speed.

26. A fuel supply control device according to claim 23, wherein the engine operating condition parameter obtaining means further obtains an opening of the throttle valve, wherein the reference parameter calculating means further calculates a reference opening, and wherein the determining means determines that the engine operating condition is within the selected condition range when the changed engine speed is higher than the first reference speed and when the opening of the throttle valve is lower than or equal to the reference opening.

27. A fuel supply control device according to claim 26, wherein the reference parameter calculating means further calculates a second reference speed which is lower than the first reference speed, and wherein the determining means determines that the engine operating condition becomes outside the selected condition range when the changed engine speed becomes lower than the second reference speed, or when the opening of the throttle valve becomes larger than the reference opening.

28. A fuel supply control device according to claim 22, the device further comprising fuel amount calculating means for calculating an amount of fuel fed by the fuel injector, wherein the engine operating condition parameter obtaining means obtains the amount of fuel fed by the fuel injector, the parameter changing means changes the amount of fuel fed by the fuel injector, wherein the reference parameter calculating means calculates a first reference amount, and wherein the determining means determines that the engine operating condition is within the selected condition range when the changed amount of fuel fed by the fuel injector is smaller than the first reference amount.

29. A fuel supply control device according to claim 28, wherein the parameter changing means changes the amount of fuel fed by the fuel injector by a changing coefficient, the changing coefficient becoming larger to thereby make the changed amount of fuel larger when the storing capacity of the canister becomes lower.

30. A fuel supply control device according to claim 28, wherein the reference parameter calculating means further calculates a second reference amount which is larger than the first reference amount, and wherein the changed amount of fuel fed by the fuel injector is compared with the first reference amount when the changed amount of fuel fed by the fuel injector is kept smaller than the second reference amount for a predetermined period.

31. A fuel supply control device according to claim 30, wherein the engine operating condition parameter obtaining means further obtains an engine speed, wherein the reference parameter calculating means further calculates a reference speed, and wherein the determining means determines that the engine operating condition is within the selected condition range when the changed amount of fuel fed by the fuel injector is smaller than the first reference amount and when the engine speed is higher than the reference speed.

32. A fuel supply control device according to claim 31, wherein the determining means determines that the engine operating condition becomes outside the selected condition range when the changed amount of fuel fed by the fuel injector becomes larger than the first reference amount, or when the engine speed becomes lower than the reference speed.

33. A fuel supply control device according to claim 22, the device further comprising fuel vapor amount calculating means for calculating an amount of fuel vapor fed into the engine, wherein the storing capacity calculating means calculates the storing capacity of the canister on the basis of the amount of fuel vapor fed into the engine.

34. A fuel supply control device according to claim 33, the fuel vapor amount calculating means comprising fuel vapor concentration coefficient calculating means for calculating a fuel vapor concentration coefficient representing a concentration of fuel vapor in air fed into the engine, wherein the storing capacity calculating means calculates the storing capacity of the canister on the basis of the fuel vapor concentration coefficient.

35. A fuel supply control device according to claim 34, the engine further having an exhaust passage, the device further comprising an air-fuel ratio sensor arranged in the exhaust passage for detecting an air-fuel ratio, and fuel amount correcting means for correcting an amount of fuel to be fed by the fuel injector by a feedback correction coefficient to make the air-fuel ratio equal to a target air-fuel ratio, the feedback correction coefficient being calculated in accordance with the output signals of the air-fuel ratio sensor and having a reference value around which the feedback correction coefficient deviates, wherein the fuel vapor concentration coefficient calculating means calculates the fuel vapor concentration coefficient on the basis of the deviation of the feedback correction coefficient from the reference value thereof, which deviation is caused when the purging operation is carried out.

36. A fuel supply control device according to claim 33, wherein the parameter changing means changes the engine operating condition parameter by a changing coefficient, the changing coefficient being calculated on the basis of the amount of the fuel vapor fed into the engine.

37. A fuel supply control device according to claim 22, wherein the parameter changing means changes the at least one engine operating condition parameter on the basis of the storing capacity of the canister, when the storing capacity of the canister is lower than a predetermined value.

38. A fuel supply control device according to claim 37, the device further comprising a temperature sensor for sensing a temperature representing an engine temperature, wherein the parameter changing means changes the at least one engine operating condition parameter on the basis of the temperature representing the engine temperature, regardless the storing capacity of the canister, when the storing capacity of the canister is higher than the predetermined value.

39. A fuel supply control device according to claim 38, wherein the parameter changing means changes the at least one engine operating condition parameter to make the selected condition range narrower when the temperature representing the engine temperature becomes lower, when the storing capacity of the canister is higher than the predetermined value.

40. A fuel supply control device according to claim 38, wherein the temperature representing an engine temperature is a temperature of an engine cooling water.

* * * * *